US006281781B1

(12) United States Patent
Yamaguchi

(10) Patent No.: US 6,281,781 B1
(45) Date of Patent: Aug. 28, 2001

(54) CIRCUIT BREAKER

(75) Inventor: Noboru Yamaguchi, Shizuoken-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/438,766

(22) Filed: Nov. 12, 1999

(30) Foreign Application Priority Data

Nov. 16, 1998 (JP) ..... 10-325601
Mar. 10, 1999 (JP) ..... 11-064055

(51) Int. Cl.[7] ..... H01H 37/76; H01H 85/055

(52) U.S. Cl. ..... 337/401; 337/405; 337/182; 337/185; 361/115

(58) Field of Search ..... 337/157, 182, 337/401, 404, 405, 406, 408, 409, 185; 307/9.1–10.8, 119; 180/271, 274, 279, 281–283; 200/61.08; 361/115; 280/227

(56) References Cited

U.S. PATENT DOCUMENTS 2,798,921 * 7/1957 Haas ..... 200/123
3,698,323 * 10/1972 Apstein et al. ..... 102/70.2 R
3,748,413 * 7/1973 Sawyer ..... 200/61.08
3,958,206 * 5/1976 Klint ..... 337/406
4,124,835 * 11/1978 Cahill, Jr. ..... 337/1
4,150,266 * 4/1979 Patrichi ..... 200/61.08
4,224,487 * 9/1980 Simonsen ..... 200/61.08
4,311,890 * 1/1982 Schroder ..... 200/61.08
4,821,010 * 4/1989 Plasko ..... 337/405
5,535,842 * 7/1996 Ritcher et al. ..... 180/279
5,877,563 * 3/1999 Krappel et al. ..... 307/10.1

FOREIGN PATENT DOCUMENTS 10-55742 * 2/1998 (JP) ..... H01H/39/00
10-241523 * 9/1998 (JP) ..... H01H/39/00
10-241524 * 9/1998 (JP) ..... H01H/39/00

* cited by examiner

*Primary Examiner*—Leo P. Picard
*Assistant Examiner*—Anatoly Vortman
(74) *Attorney, Agent, or Firm*—Finnegan, Henderson, Farabow, Garrett & Dunner, L.L.P.

(57) ABSTRACT

The disclosed circuit breaker comprises a first connection terminal, a second connection terminal, a heat generating part having conductivity and disposed between the first connection terminal and second connection terminal, an igniting part igniting depending on a cut-off signal, an expandable elastic member capable of applying a force to the heat generating part so as to be departed from between the first connection terminal and second connection terminal, a container accommodating the heat generating part, igniting part and elastic member, and a retaining part for retaining the elastic member in compressed state. Herein, at least a portion of the retaining part is provided in the container, and as the igniting part ignites depending on the cut-off signal and the heat generating part generates heat, and the retaining part releases the elastic member, the elastic member applies the force to the heat generating part, and the heat generating part is departed from between the first connection terminal and second connection terminal, so that the conductive state between the first connection terminal and second connection terminal is cut off.

17 Claims, 24 Drawing Sheets

*Prior Art*

*Prior Art*

CIRCUIT BREAKER

BACKGROUND OF THE INVENTION

The present invention relates to a circuit breaker, and more particularly to a circuit breaker for cutting off an electric circuit in a short time.

In an electric equipment system installed in a vehicle, if any abnormality should occur due to load of power window or the like, or if any abnormality should occur in the wire harness or the like composed of plural wires connecting the battery and each load, a large-current fuse interposed between the battery and the wire harness is melted to cut off between the battery and the wire harness, thereby preventing the loads and wire harness from burning down.

In the electric equipment system using such large-current fuse, however, if any abnormality should occur in the load such as power window, or if abnormality should occur in the wire harness of the like connecting the battery and each load, it is set so as not to melt down unless a current large than the preset allowable value flows in the large-current fuse.

Recently, various protective devices have been developed for cutting off between the battery and wire harness by detecting when a large current close to the allowable value is flowing continuously.

SUMMARY OF THE INVENTION

According to the investigation by the present inventor, a protective device as shown in FIG. 36 is considered.

FIG. 36 is a sectional view showing an example of protective device using a bimetal.

Such protective device comprises a housing 103 made of an insulating resin or the like, and forming a fuse compartment 102 at the upper side, a lid 113 for opening and closing the fuse compartment 102 of the housing 103, a power source terminal 105 disposed at the lower side of the housing 103 so that its upper end portion projects into the fuse compartment 102, and the lower end exposed outside, with the portion exposed outside connected to a positive terminal of a battery 104, and a load terminal 109 disposed at the lower side of the housing so that its upper end portion projects into the fuse compartment 102, and the lower end exposed outside, with the portion exposed outside connected to a load 108 through a wire 107 for composing a wire harness 106.

Such protective device further comprises a fusible element 110 made of a low melting point metal disposed in the fuse compartment 102, with one end connected to the upper end of the power source terminal 105, and other end connected to the upper end of the load terminal 109, an intermediate terminal 111 disposed at an intermediate position of the power source terminal 105 and load terminal 109, with the lower end disposed at the lower side of the housing 103 so as to be exposed outside, and the portion exposed outside connected to a negative terminal of the battery 104, and a bimetal 112 made of two long plate members of different metals glued together, with the lower end side connected to the upper end of the intermediate terminal 111 and the upper end side being bent in an L-shape and disposed oppositely to the fusible element 110.

In such constitution, by manipulation of an ignition switch or the like of the vehicle, while a current is flowing in a route of positive terminal of battery 104, power source terminal 105, fusible element 110, load terminal 109, wire 107 of wire harness 106, load 108, and negative terminal of battery 104, if any abnormality should occur in the load 108 or the wire harness 106 connecting the load 108 and the protective device 101, and a current exceeding the allowable value should flow in the fusible element 110, it is heated and melted down.

As a result, the circuit is cut off, and the load 108 and wire harness 106 are protected.

Or when a large current flows in the fusible element 110 due to some abnormality occurring in the load 108 or the wire harness 106 connecting the load 108 and protective device 101, if it does not exceed the allowable value, the fusible element 110 is heated by the current flowing in the fusible element 110, and the bimetal 112 begins to deform. In a specified time after a large current begins to flow in the fusible element 110, the leading end of the bimetal 112 contacts with the fusible element 110, and a large short-circuit current flows in the fusible element 110 in a route composed of positive terminal of battery 104, power source terminal 105, fusible element 110, intermediate terminal 111 and negative terminal of battery 104, so that it is melted down.

As a result, if lower than the allowable value, when a certain current flows longer than a preset time, the circuit is cut off, and the wire harness 106 and load 108 are protected.

Aside from such protective device 101, a protective device 121 shown in FIG. 37 is also devised by the present inventor.

The protective device 121 shown in FIG. 37 comprises a housing 122 made of insulating resin or the like, a power source terminal 124 buried at one side of the housing 122, with the lower end portion connected to a positive terminal of a battery 123, and a load terminal 128 buried at other side of the housing 122, with the lower end portion connected to a load 127 through a wire 126 composing a wire harness 125.

Moreover, one end of a wire 131 composed of a fusible conductor 129 made of a low melting point metal or the like formed in a U-shape and a heat resistant covering 130 formed to cover the fusible conductor 129 is connected to the upper end of the power source terminal 124, and other end is connected to the upper end of the load terminal 128. This wire 131 has a coil 132 made of a shape memory alloy, showing a shape being wound around the wire 131 as shown in FIG. 9 when it is in martensite phase, and returning to the mother phase in a shape of tightening the wire 131 when heated to temperature of 120° C. to 170° C.

Further, outside of the housing 122, there is an external terminal 133 with the upper end connected to one end of the coil 132 and lower end connected to a negative terminal of the battery 123.

In such constitution, by manipulation of an ignition switch or the like of the vehicle, while a current is flowing in a route of positive terminal of battery 123, power source terminal 124, fusible element 129 of wire 131, load terminal 128, wire 126 of wire harness 124, load 127, and negative terminal of battery 123, if any abnormality should occur in the load 127 or the wire harness 125 connecting the load 127 and the protective device 121, and a current exceeding the allowable value should flow in the fusible element 129, it is heated and melted down.

As a result, the circuit is cut off, and the load 127 and wire harness 125 are protected.

Or when a large current flows in the fusible conductor 129 due to some abnormality occurring in the load 127 or the wire harness 125 connecting the load 127 and protective device 121, if it does not exceed the allowable value, the fusible conductor 129 is heated by the current flowing in the fusible conductor 129, and the temperature of the coil 132 climbs up. In a specified time after a large current begins to flow in the fusible conductor 129, when the temperature of the coil 132 reaches 120° C. to 170° C., the coil 132 is shifted from the martensite phase to the mother phase, and bites into the heat resistant covering 130 softened by heat, an contacts with the fusible conductor 129, and a large short-circuit current flows in the fusible conductor 129 in a route composed of positive terminal of battery 123, power source terminal 124, fusible conductor 129, coil 132, external terminal 133 and negative terminal of battery 123, so that it is melted down.

As a result, if lower than the allowable value, when a certain current flows longer than a preset time, the circuit is cut off, and the wire harness 125 and load 127 are protected.

In these protective devices 101 and 121, however, the following problems have been disclosed.

First, in the protective device shown in FIG. 36, since flow of large current in the fusible element 110 is detected by using the bimetal 112 gluing two kinds of metals differing in the coefficient of thermal expansion, if the magnitude of the current flowing in the fusible element 110 changes, the bimetal 112 is deformed, and the time until cutting off the circuit varies.

Accordingly, in the event of such an abnormality that a large current flows intermittently, the temperature of the fusible element 101 does not rise higher than a certain point, and the protective device 101 may not cut off the circuit appropriately.

On the other hand, in the protective device 121 shown in FIG. 37, since flow of large current in the fusible conductor 129 is detected by using the coil 132 made of shape memory alloy, if the magnitude of the current flowing in the fusible conductor 129 changes, the coil 132 is deformed, and the time until cutting off the circuit varies.

Accordingly, in the event of such an abnormality that a large current flows intermittently, the temperature of the fusible conductor 129 does not rise higher than a certain point, and the protective device 121 may not cut off the circuit appropriately.

Or, in the protective device shown in FIG. 36 and FIG. 37, the heat reaction time of heat deforming conductive members such as bimetal 112 and 132 may vary depending on the passing current. A preferred operating temperature for bimetal or shape memory alloy is about 100° C., but the environmental temperature of the vehicle is about 120 to 125° C., and it is not a preferred environment. It is further predicted that the heat reaction of the heat deforming conductive member may not take place timely in the event of abnormality such as passing of overcurrent.

The invention is devised in the light of the above background, and it is hence an object thereof to present a circuit breaker capable of protecting electric parts by securely cutting off the circuit in a short time in the event of input of a failure signal of a vehicle.

The circuit breaker of the invention comprises a first connection terminal, a second connection terminal, a heat generating part having conductivity and disposed between the first connection terminal and second connection terminal, an igniting part igniting depending on a cut-off signal, an expandable elastic member capable of applying a force to the heat generating part so as to be departed from between the first connection terminal and second connection terminal, a container accommodating the heat generating part, igniting part and elastic member, and a retaining part for retaining the elastic member in compressed state. Herein, at least a portion of the retaining part is provided in the container, and when the retaining part retains the elastic member in compressed state and the heat generating part is positioned between the first connection terminal and second connection terminal, the conductive state between the first connection terminal and second connection terminal is maintained, and as the igniting part ignites depending on the cut-off signal and the heat generating part generates heat, and the retaining part releases the elastic member, the elastic member applies the force to the heat generating part, and the heat generating part is departed from between the first connection terminal and second connection terminal, so that the conductive state between the first connection terminal and second connection terminal is cut off.

In this constitution, when the igniting part ignites by a failure signal from outside, the heat generating part generates heat, and by this heat the holding part is melted. As a result, the compressed elastic member is expanded to kick up the heat generating part, and the electric connection between the heat generating part and the first connection terminal and second connection terminal is cut off. As the electric connection between the first connection terminal and second connection terminal is cut off, the circuit is securely cut off in a short time, so that the electric parts can be protected.

Herein, the retaining part includes a resin part, preferably, and the resin part is melted as the igniting part ignites depending on the cut-off signal and the heat generating part generates heat, so that retaining of the elastic member is released quickly.

Specifically, the retaining part is a fixing part for tightening and fixing the heat generating part to the container so that the elastic member may be maintained in compressed state in a simple constitution, and more specifically the fixing part preferably comprises a first threaded part formed in the heat generating part and a second threaded part formed in the container so as to be engaged with the first threaded part.

Alternatively, the retaining part may be also a protrusion formed in the container so as to resist the force of the elastic member. More specifically, the container has an upper case and a lower case fitting to the upper case, and the protrusion is provided in the inner wall of the upper case at a position confronting the upper surface of the heat generating part, so that the elastic member may be maintained in compressed state securely in a simple constitution.

On the other hand, a side wall is formed at the end of the heat generating part, and the end of the first connection terminal and the side wall, and the end of the second connection terminal and the side wall may be individually joined with low melting point materials.

In such constitution, usually, the conduction between the first connection terminal and second connection terminal is improved by the low melting point material, and in case of abnormality, the low melting point material is melted securely by the heat generation of the heating agent, and the electric connection between the first connection terminal and second connection terminal is cut off by the force of the elastic member. Usually, meanwhile, since no force is applied to the low melting point material, the reliability of junction between the first connection terminal and second connection terminal is enhanced.

Alternatively, between the end of the first connection terminal and the end of the second connection terminal, a conductive member may be provided under pressure welding.

In such constitution, usually, the conduction between the first connection terminal and second connection terminal is improved by the conductive member. Moreover, since no force is usually applied to the junction of the first connection terminal and second connection terminal, the reliability of junction between the first connection terminal and second connection terminal is enhanced.

When attaching, in order to position the first connection terminal, second connection terminal and heat generating part securely, and prevent from turning when tightening with screw, a bent part is respectively provided in the first connection terminal and second connection terminal, and the heat generating part is preferred to have a groove to be fitted with such a bent part.

On the other hand, in order that force may not be applied to the first connection terminal and second connection terminal more securely, a side wall is formed at the end of the heat generating part, and preferably a protrusion is respectively formed in the first connection terminal and second connection terminal so as to press the side wall.

Also when attaching, in order to absorb the reaction of screw tightening, notch or concave and convex part should be preferably formed in the first connection terminal and second connection terminal. Similarly, to absorb the reaction of screw tightening, a gap may be formed between the first connection terminal and second connection terminal and the side wall of the heat generating part, respectively.

The low melting point material is preferred to be one selected from the group consisting of Sn, Pb, Zn, Al and Cu.

The heat generating part includes the heating agent, and the heating agent is preferred to include a thermite compound mixing powder of metal oxide and powder of aluminum because the thermite reaction heat can be securely generated by the thermite reaction.

In other words, the heat generating part contains the heating agent, and the heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

Further, the heating agent may also contain additives having alumina, bentonite or talc.

DETAILED DESCRIPTION OF THE PREFERRED EMBODIMENTS

Figure 1:
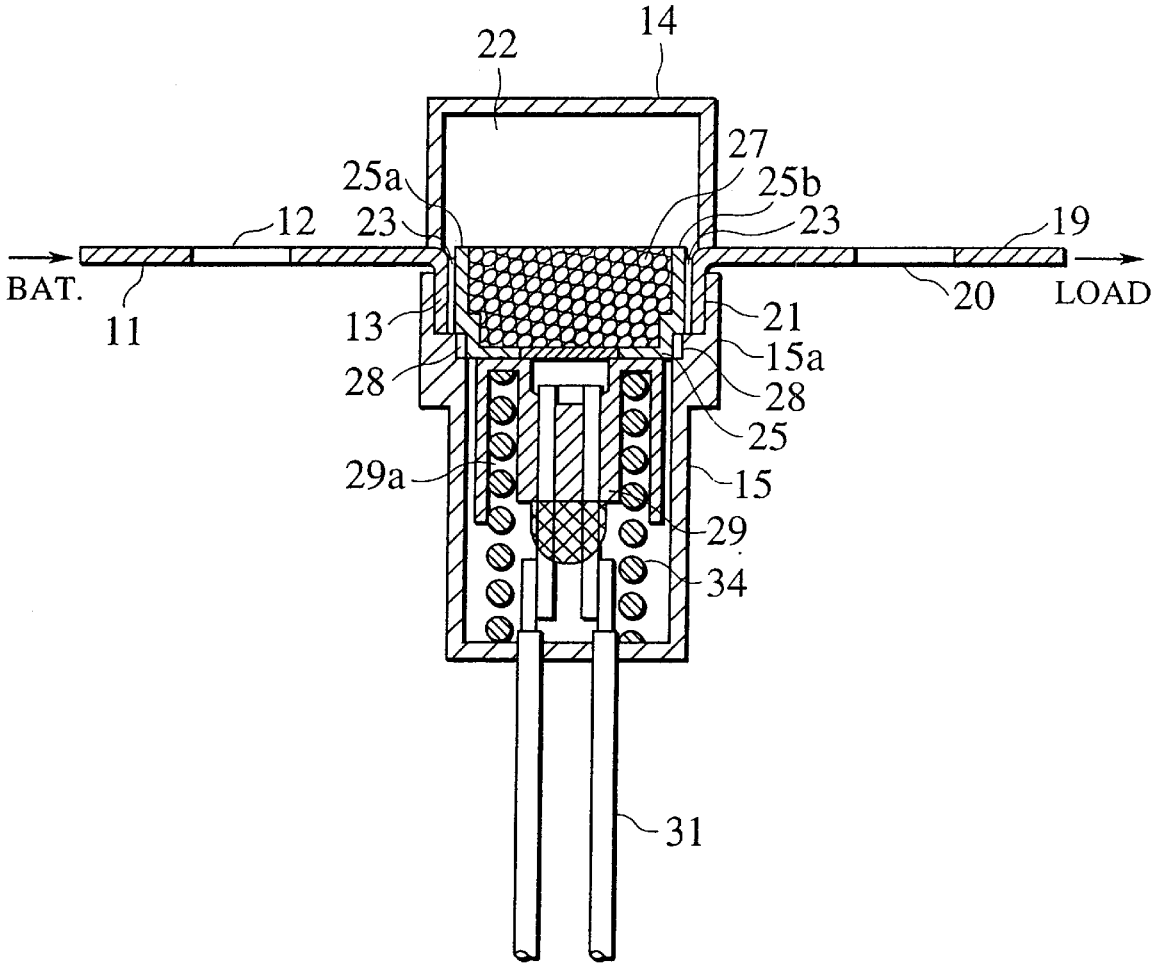
FIG. 1 is a sectional view before cut-off of a circuit breaker in a first embodiment of the invention.
Figure 2:
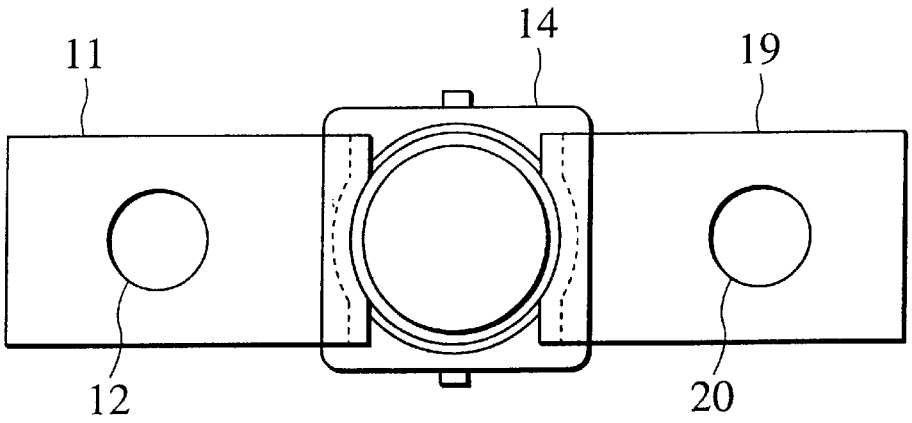
FIG. 2 is a top view of the circuit breaker of the embodiment.

Referring now to the drawings, each of preferred embodiments of the invention is described in detail below.

A first embodiment of the invention is described below.

In the circuit breaker shown in FIG. 1 to FIG. 4, a first bus bar 11 of a long plate form is made of copper or copper alloy, and a round hole 12 to be connected to a battery or the like is formed in this first bus bar 11. A leading end 13 of the first bus bar 11 is bent downward nearly at right angle.

A second bus bar 19 of a long plate form is also made of copper or copper alloy, and a round hole 20 to be connected to a load or the like is formed in this second bus bar 19. A leading end 21 of the second bus bar 19 is also bent downward nearly at right angle.

Between the first bus bar 11 and second bus bar 19, a cap 14 having a cavity 22 is disposed at the upper side, and an outer case 15 having a case step 15*a* is disposed at the lower side. The cap 14 and outer case 15 constitute an outer container of insulating material, and a thermoplastic resin is preferably used.

A thermite case 25 of a lid form is contained in the outer case 15, and this thermite case 25 is filled with a heating agent 27. The thermite case 25 is made of metal excellent in thermal conductivity and not melted by the heat generation of the heating agent 27, and brass, copper, copper alloy, stainless steel or the like may be used.

The thermite case 25 is disposed at a position of a nearly same height as the height of the first bus bar 11 and second bus bar 19, and the thermite case 25 has a left side wall 25*a* and a right side wall 25*b*.

The left side wall 25*a* is joined to the leading end 13 of the first bus bar 11 by means of a low melting point metal 23 as low melting point material with melting point about 200 to 300° C. As such low melting point material, solder is used. The right side wall 25*b* is joined to the leading end 21 of the second bus bar 19 by means of low melting point metal 23. Accordingly, the first bus bar 11 and second bus bar 19 can be electrically connected with each other through the low melting point metal 23 and thermite case 25.

As the low melting point metal 23, at least one metal selected from the group consisting of Sn, Pb, An, Al and Cu is preferably used.

The heating agent 27 is a thermite compound composed of powder of metal oxide such as iron oxide ($Fe_2O_3$) and powder of aluminum, which generates high heat by inducting thermite reaction by heat generation of the led wire 31. As the metal oxide, instead of iron oxide ($Fe_2O_3$), chromium oxide ($Cr_2O_3$) or manganese oxide ($MnO_2$) may be used.

The heating agent 27 may be also a mixture composed of at least one metal powder selected from the group consisting of B, Sn, Fe, Si, Zr, Ti and Al, at least one metal oxide selected from the group consisting of CuO,$MnO_2$, $Pb_3O_4$, $PbO_2$, $Fe_2O_4$ and $Fe_2O_3$, and at least one additive selected from the group consisting of alumina, bentonite and talc. By using such heating agent, it is easily ignited by the igniting part 29, and the low melting point metal 23 can be melted in a short time.

Figure 3:
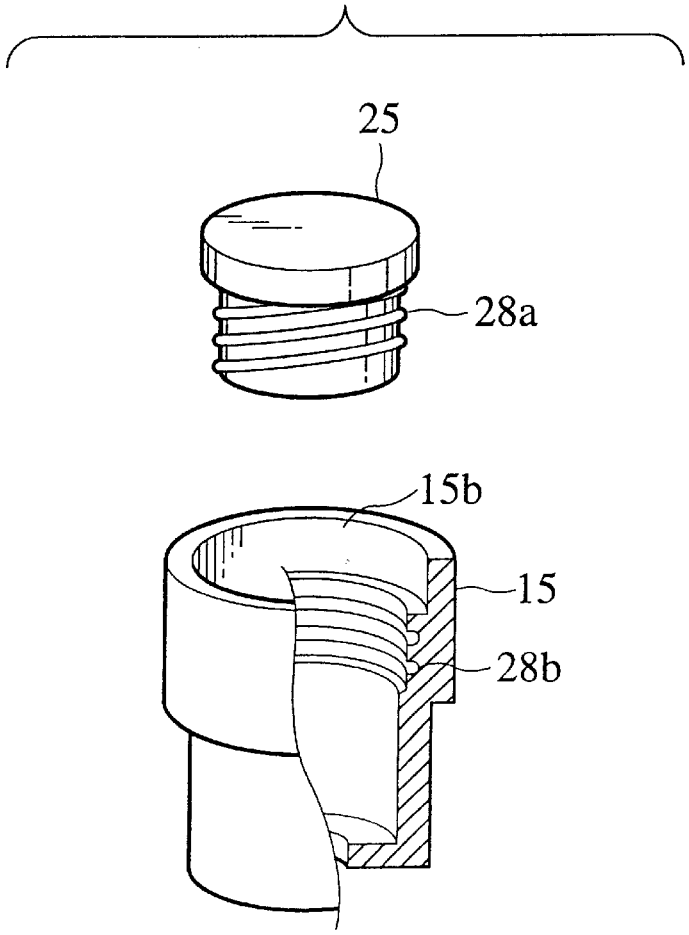
FIG. 3 is a detailed view of threaded parts formed in a thermite case and an outer case of the embodiment.

As a fixing part for tightening and fixing the thermite case 25 to the outer case 15, a threaded part 28 is disposed at the lower side of the thermite case 25. The thermite case 25 can be contained in a thermite compartment 15*b* formed in the case step 15*a* of the outer case 15 as shown in FIG. 3.

The threaded part 28 consists of a thermite threaded part 28*a* forming male threads as a first threaded part formed in the thermite case 25, and an outer case threaded part 28*b* as a second threaded part forming female threads in the case step 15*a* to e engaged with this thermite threaded part 28*a*. At least one threaded part of the thermite threaded part 28*a* and outer case threaded part 28*b* is made of a resin member.

In the lower part of the thermite case 25, an igniting part 29 is disposed, and the igniting part 29 is contained in the outer case 15, and has an igniting agent, and the igniting agent is ignited by heat generation caused by the current flowing in a lead wire 31 in case of abnormality of vehicle such as vehicle collision accident, and a thermite reaction heat is generated in the heating agent 27.

The igniting part 29 has a groove 29*a*, and between this groove 29*a* and the bottom of the outer case 15, there is a compression spring 34 as an expandable elastic member, and this compression spring 34 is compressed in the state shown in FIG. 1.

Figure 4:
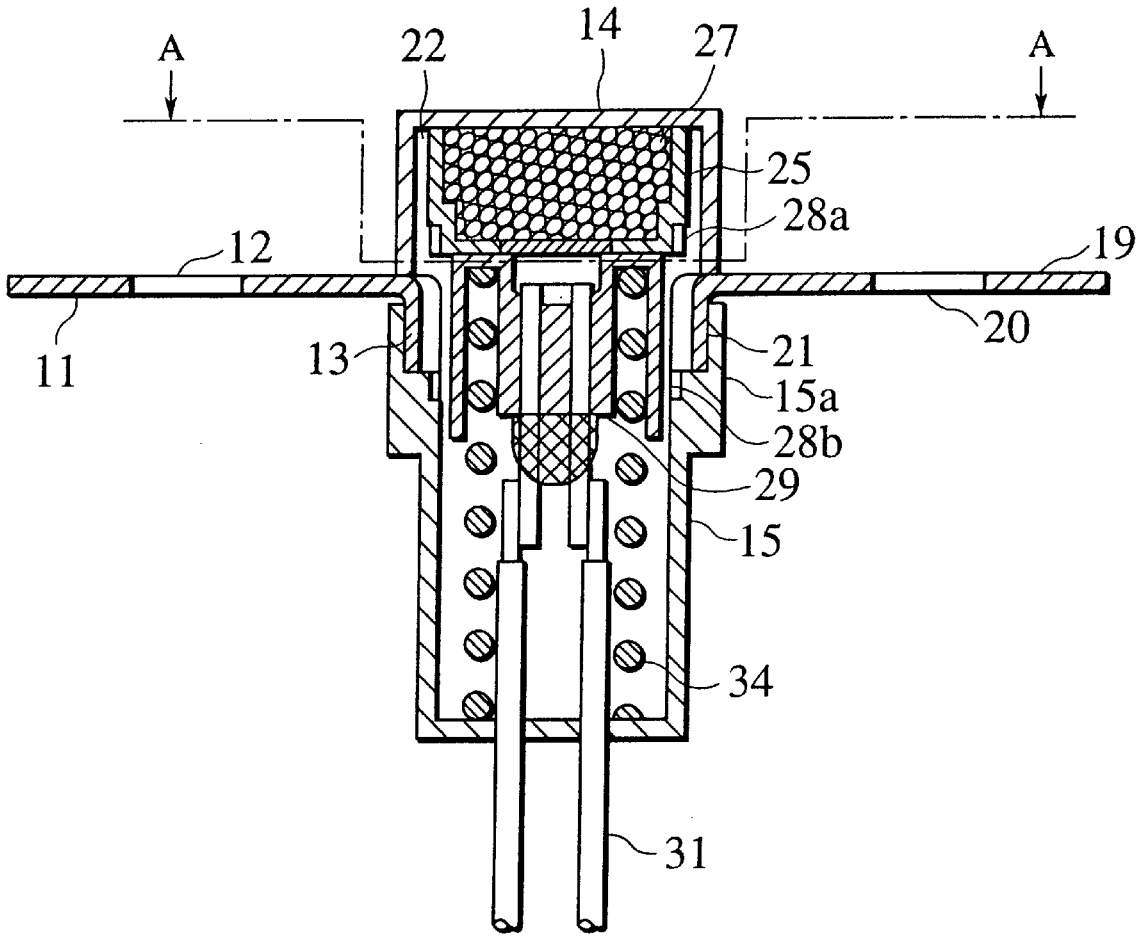
FIG. 4 is a sectional view after cut-off of the circuit breaker of the embodiment.

In the state after cut-off of the circuit, as shown in FIG. 4, when the low melting point metal 23 and threaded part 28 are heated and melted by the thermite reaction heat of the heating agent 27, the compression spring 34 expands, and the thermite case 25 bounces up to the cap 14.

In thus constituted circuit breaker of the embodiment, the operation is described below.

Usually, the first bus bar 11 and second bus bar 19 are electrically connected with each other through the low melting metal 23 and thermite case 25, and a current is supplied from a battery to a load (neither shown).

If the vehicle collides against an obstacle or tumbles off a cliff or the like, the abnormality of the vehicle is detected by a collision sensor or the like. By detection of such abnormality of vehicle, a current flows into the igniting part 29 through the lead wire 31.

As a result, by heat generation by the current, the igniting part 29 ignites, and the heating agent 27 which is the thermite compound generates thermite reaction heat in the following reaction formula.

$$Fe_2O_3+2Al \rightarrow Al_2O_3+2Fe+386.2 \text{ (kcal)}$$

By this thermite reaction heat, the thermite case 25 is heated, and by the heat generation of the heating agent 27 and the heat of the thermite case 25, the low melting point metal 23 joining the bus bar leading end 13 and the left side wall 25*a* of the thermite case 25, and the low melting point metal 23 joining the bus bar leading end 21 and the right side wall 25*b* of the thermite case 25 are heated and melted. At the same time, the threaded part 28 made of resin member for fixing the thermite case 25 to the outer case 15 by screwing is melted by this heat.

As a result, the tightening force of the thermite case 25 to the outer case 15 becomes weak, and the compressed compression spring 34 expands, and the thermite case 25 and igniting part 29 bounce up as shown in FIG. 4, so that the thermite case 25 is contained in the cavity 22 in the cap 14.

Accordingly, the electric connection between the thermite case 25 and the first bus bar 11 and second bus bar 19 is cut off. That is, the first bus bar 11 and second bus bar 19 are electrically cut off, and the electric circuit of the vehicle is cut off.

In the circuit breaker of the first embodiment, by input of failure signal from the vehicle, and ignition of the igniting part 29, thermite reaction induced by the heating agent 27, and the low melting point metal 23 and the threader part 28 are melted by this thermite reaction heat, so that the compression spring 34 pops up instantly.

Therefore, the electric circuit of the vehicle can be cut off securely in a short time, and the electric parts can be protected. Moreover, by using the thermite reaction heat of the heating agent 27, the circuit breaker in a simple structure can be presented.

Since the threaded part 28 arrests upward expansion force of the compression spring 34, spring force is not applied to the low melting point metal 23 at the junction of the first bus bar 11 and second bus bar 19 and the thermite case 25, so that the reliability of the junction may be enhanced. Further, since the compression spring 34 is used, it is inexpensive, and designing and assembling of the circuit breaker will be easier.

Further, in the case of bonding by using low melting point metal such as solder, at the junction, generation of crack due to diffusion of components of low melting point metal is suppressed. Because of low melting point metal, it is possible to bond at a relatively low temperature, and diffusion temperature when bonding can be suppressed low, and formation of intermetallic compound which is likely to lead to generation of cracks can be effectively reduced.

A circuit breaker in a second embodiment of the invention is described below.

Figure 5:
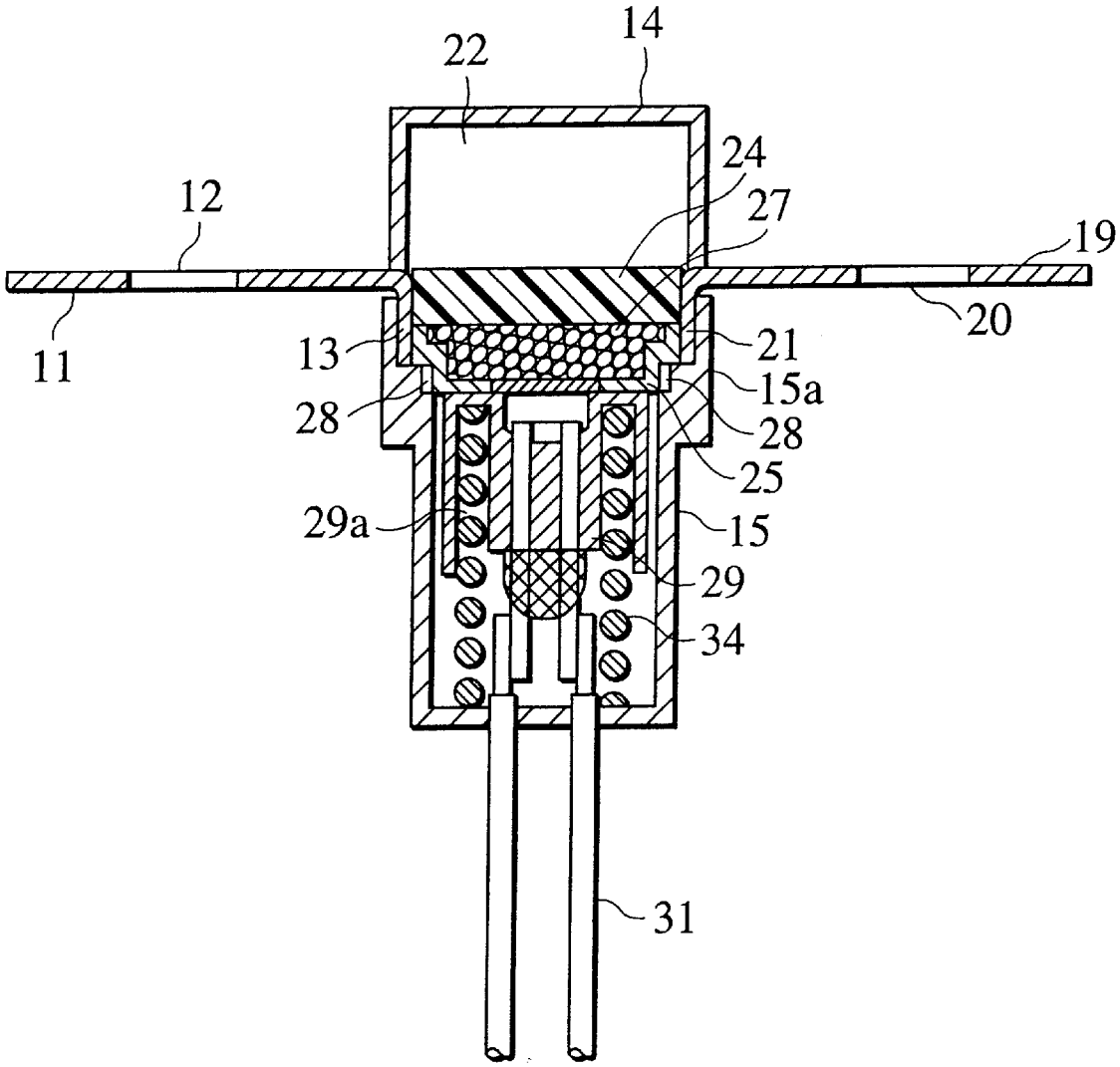
FIG. 5 is a sectional view before cut-off of a circuit breaker in a second embodiment of the invention.
Figure 6:
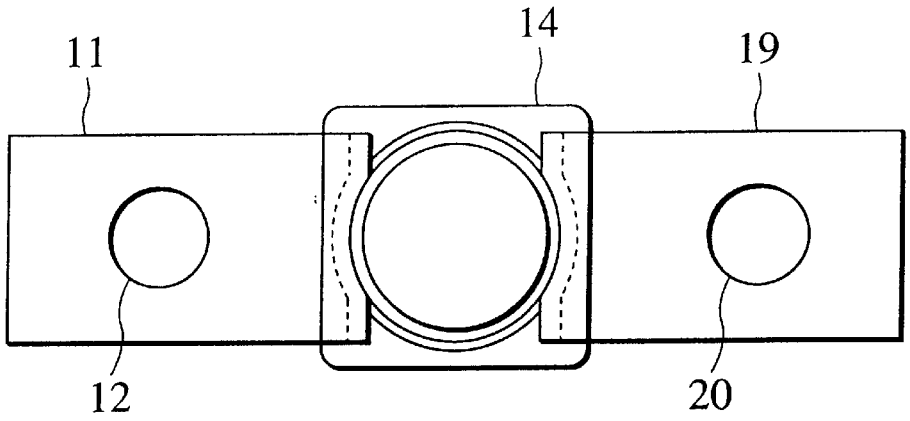
FIG. 6 is a top view of the circuit breaker of the embodiment.
Figure 7:
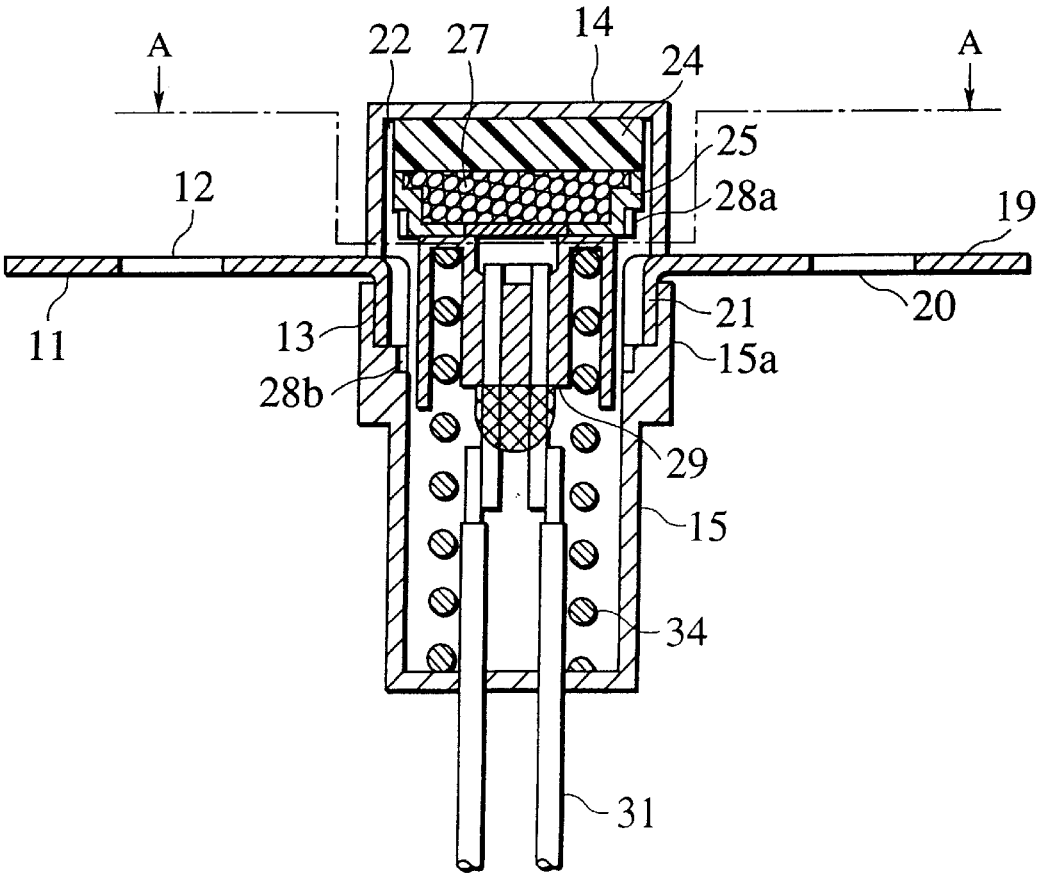
FIG. 7 is a sectional view after cut-off of the circuit breaker of the embodiment.

In this embodiment, parts shown in FIG. 5 to FIG. 7 are identified with same reference numerals in the parts corresponding to the first embodiment shown in FIG. 1 to FIG. 4, and their detailed description is omitted.

In the circuit breaker of the embodiment shown in FIG. 5 to FIG. 7, a conductive resin 24 formed by insert molding is pressure welded and disposed between a first bus bar 11 and a second bus bar 19, and this conductive resin 25 is a resin made of a mixture of metal fiber, low melting point metal, flux and synthetic resin. As the metal fiber, copper fiber, brass fiber, aluminum fiber, stainless steel fiber or the like may be preferably used.

In the lower part of the conductive resin 24, there is a thermite case 25 filled with a heating agent 27, and an igniting part 29 is disposed in the lower part of the thermite case 25. The conductive resin 25, thermite case 25, and igniting part 29 are contained in an outer case 15.

For tightening and fixing the thermite case 25 to the outer case 15, a threaded part 28 made of a resin member is disposed at the lower side of the thermite case 25, and this threaded part 28 consists of a thermite threaded part 28*a* and an outer case threaded part 29*b* to be engaged with this thermite threaded part 28*a* same as shown in FIG. 3.

In thus constituted circuit breaker of the embodiment, the operation is described below.

Usually, the first bus bar 11 and second bus bar 19 are electrically connected with each other through the low melting metal 23 and thermite case 25, and a current is supplied from a battery to a load (neither shown). Herein, the current mainly flows into the conductive resin 24.

If the vehicle collides against an obstacle or tumbles off a cliff or the like, the abnormality of the vehicle is detected by a collision sensor or the like. By detection of such abnormality of vehicle, a current flows into the igniting part 29 through a lead wire 31.

As a result, by heat generation by the current, the igniting past 29 ignites, and the heating agent 27 which is the thermite compound generates thermite reaction heat. By this thermite reaction heat, the thermite case 25 is heated, and by the heat generation of the heating agent 27 and the heat of the thermite case 25, the threaded part 28 for fixing the thermite case 25 to the outer case 15 by screwing is melted.

As a result, the tightening force of the thermite case 25 to the outer case 15 becomes weak, and the compressed compression spring 34 expands, and the conductive resin 24, thermite case 25 and igniting part 29 bounce up as shown in FIG. 7, so that the conductive resin 24 and thermite case 25 are contained in the cavity 22 in the cap 14.

Accordingly, the electric connection between the conductive resin 24 and the first bus bar 11 and second bus bar 19 is cut off. That is, the first bus bar 11 and second bus bar 19 are electrically cut off, and the electric circuit of the vehicle is cut off.

In the circuit breaker of this embodiment, therefore, the electric circuit of the vehicle can be cut off securely in a short time, and the electric parts can be protected. Moreover, by using the thermite reaction heat of the heating agent 27, the circuit breaker in a simple structure can be presented.

Since the threaded part 28 arrests upward expansion force of the compression spring 34, spring force is not applied to the junction of the first bus bar 11 and second bus bar 1 and the conductive resin 24, so that the reliability of the junction may be enhanced. Further, since the compression spring 34 is used, it is inexpensive, and designing and assembling of the circuit breaker will be easier.

A circuit breaker in a third embodiment of the invention is described below.

Figure 8:
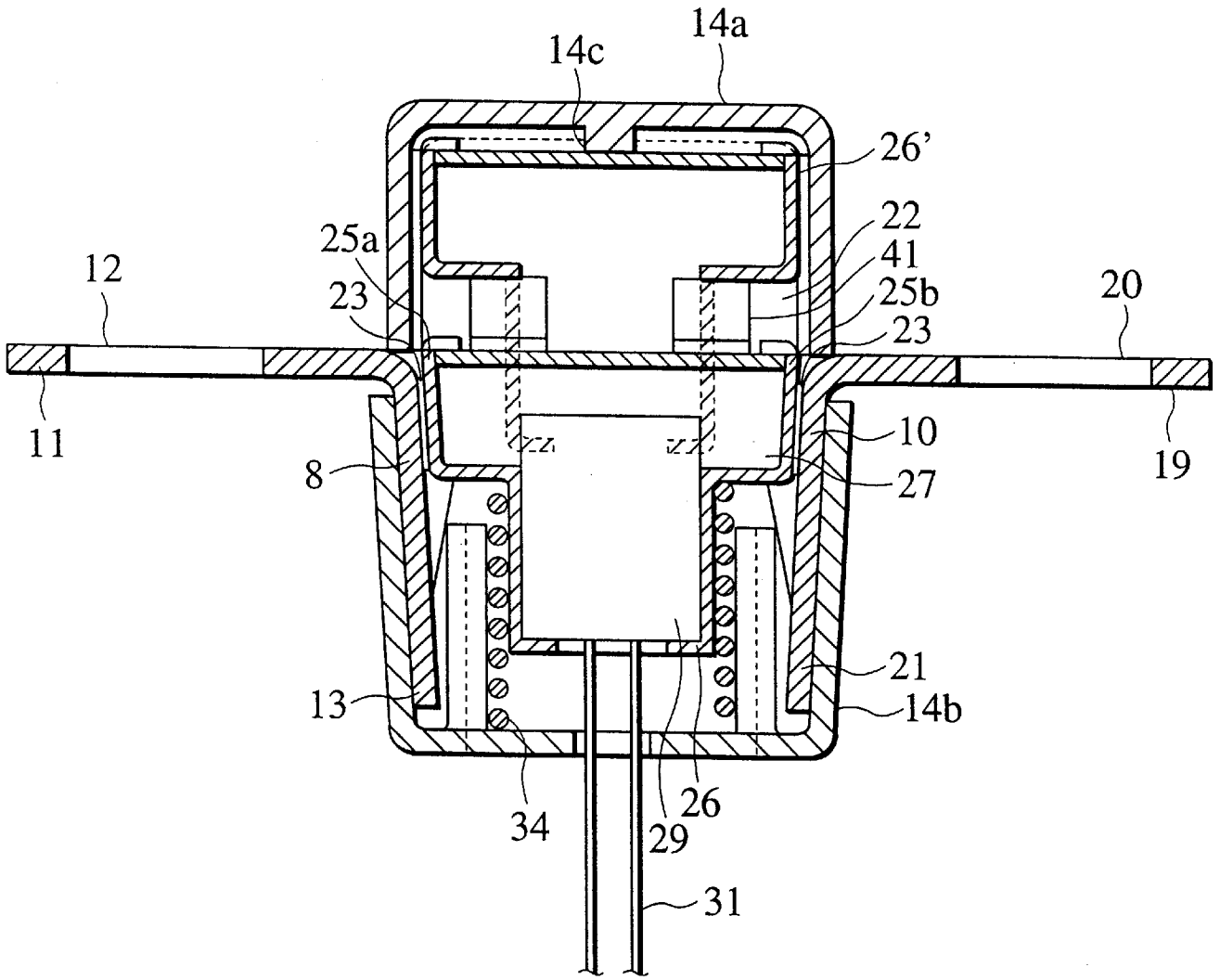
FIG. 8 is a sectional view of A—A of a circuit breaker in a third embodiment of the invention.
Figure 9:
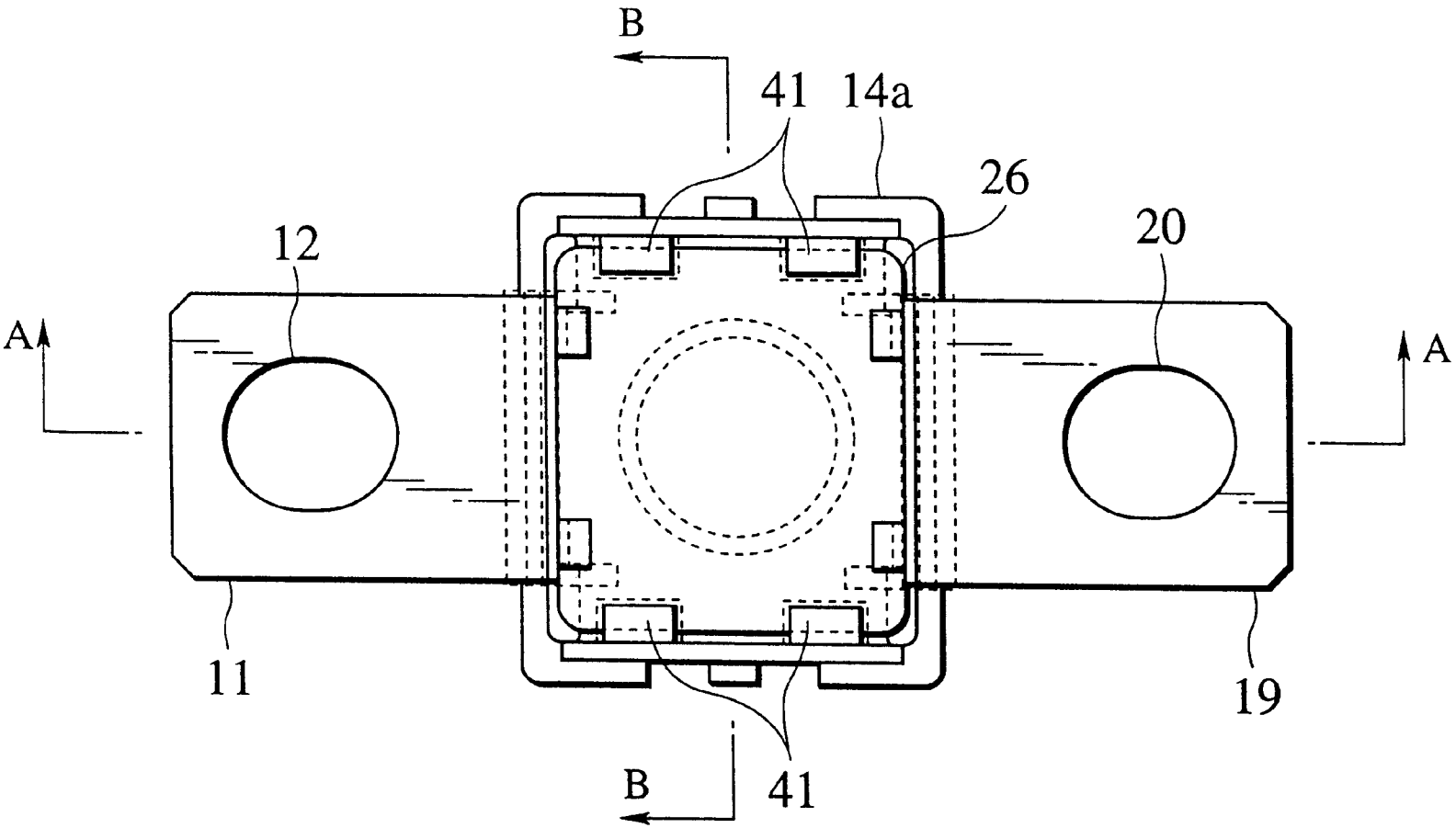
FIG. 9 is a top view of the circuit breaker of the embodiment.
Figure 10:
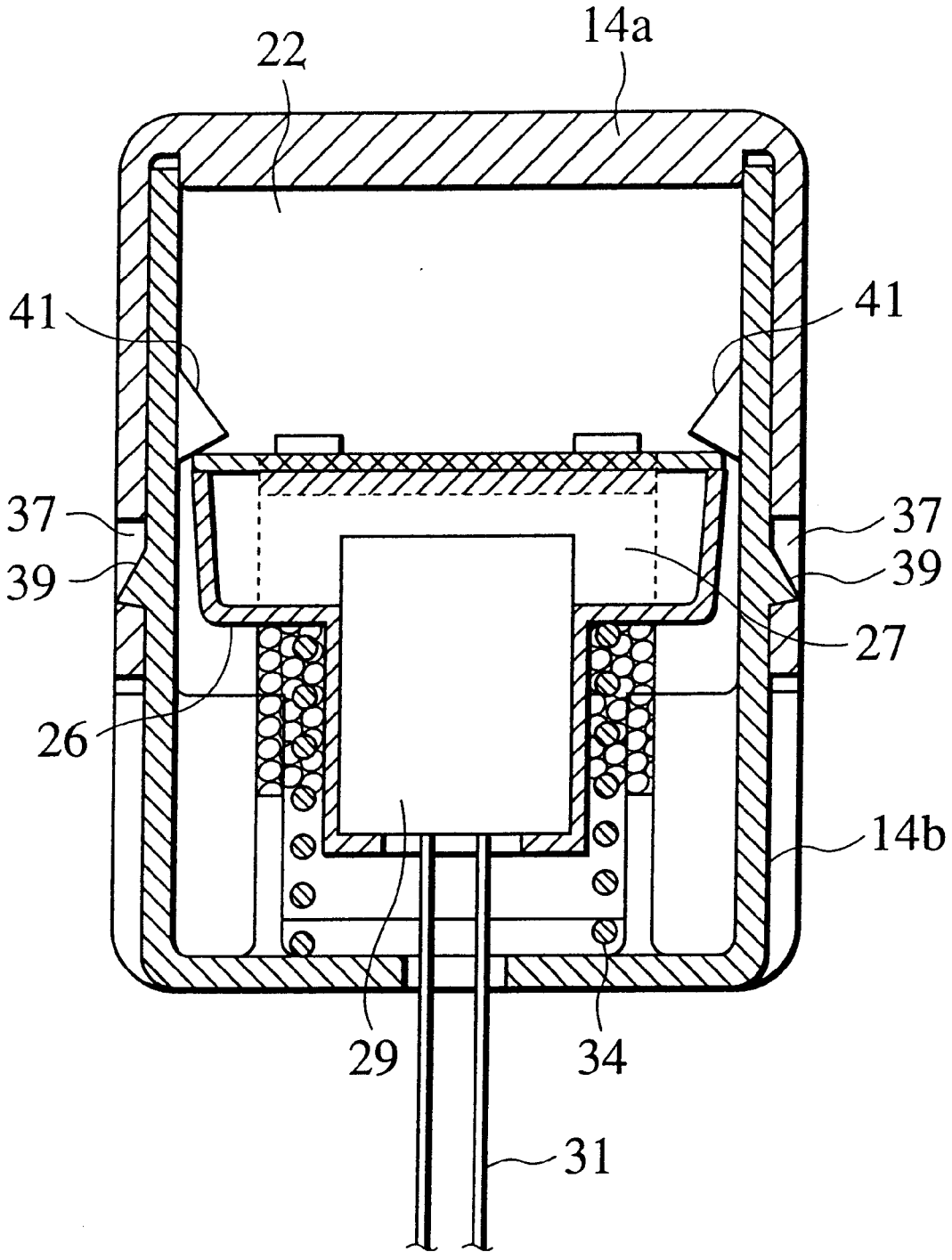
FIG. 10 is a sectional view of B—B of the circuit breaker of the embodiment.

In this embodiment, parts shown in FIG. 8 to FIG. 10 are identified with same reference numerals in the parts corresponding to the first embodiment shown in FIG. 1 to FIG. 4, and their detailed description is omitted.

In the circuit breaker of the embodiment shown in FIG. 8 to FIG. 10, an upper case 14*a* and a lower case 14*b* are disposed between a first bus bar 11 and a second bus bar 19. The upper case 14*a* has a square groove 37, and this groove 37 is engaged with a first protrusion 39 formed in the lower case 14*b*. In the lower case 14*b*, a thermite case 26 made of copper or copper alloy is contained, and this thermite case 26 is filled with a heating agent 27, and an igniting part 29 is also contained therein.

A left side wall 25*a* formed in the thermite case 26 is joined to a bent part 8 of the first bus bar 11 with a low melting point metal 23 as low melting point material, and a right side wall 25*b* is jointed to a bent part 10 of the second bus bar 19 with the low melting point metal 23.

A compression spring 34 is disposed between the thermite case 26 and lower case 14*b*, and this compression spring 34 pushes the thermite case 26 upward. The lower case 14*b* has a second protrusion 41 made of a resin member, and this protrusion 41 pushes the upper surface of the thermite case 26 so as to arrest upward move of the thermite case 26 by the spring force of the compression spring 34.

In thus constituted circuit breaker of the embodiment, the operation is described below.

Usually, the first bus bar 11 and second bus bar 19 are electrically connected with each other through the low melting metal 23 and thermite case 26, and a current is supplied from a battery to a load (neither shown).

If the vehicle collides against an obstacle or tumbles off a cliff or the like, the abnormality of the vehicle is detected by a collision sensor or the like. By detection of such abnormality of vehicle, a current flows into the igniting part 29 through a lead wire 31.

As a result, by heat generation by the current, the igniting part 29 ignites, and the heating agent 27 which is the thermite compound generates thermite reaction heat. By this thermite reaction heat, the thermite case 26 is heated, and by the heat generation of the heating agent 27 and the heat of the thermite case 26, the low melting point metal 23 joining the bent part 8 and the left side wall 25*a* of the thermite case 25, and the low melting point metal 23 joining the bent part 10 and the right side wall 25*a* of the thermite case 25 are heated and melted. At the same time, the second protrusion 41 of resin member formed in the lower case 14*b* is heated by the heat.

Then, the compressed compression spring 34 expands, the thermite case 26 containing the igniting part 29 pops up, so that the thermite case 26 is put into the cavity 22 (in FIG. 8, reference numeral 26' shows the thermite case after moving upward).

Accordingly, the electric connection between the thermite case 26 and the first bus bar 11 and second bus bar 19 is cut off. That is, the first bus bar 11 and second bus bar 19 are electrically cut off, and the electric circuit of the vehicle is cut off.

In the circuit breaker of this embodiment, therefore, the electric circuit of the vehicle can be cut off securely in a short time, and the electric parts can be protected. Moreover, by using the thermite reaction heat of the heating agent 27, the circuit breaker in a simple structure can be presented.

Moreover, since the second protrusion 41 formed in the lower case 14*b* arrests upward expansion force of the compression spring 34, spring force is not applied to the low melting point meal 23 at the junction of the first bus bar 11 and second bus bar 19 and the thermite case 26, so that the reliability of the junction may be enhanced. Further, since the compression spring 34 is used, it is inexpensive, and designing and assembling of the circuit breaker will be easier.

A circuit breaker in a fourth embodiment of the invention is described below.

The circuit breaker of this embodiment is characterized by bonding of thermite case and bus bars in order that positioning may be easy when joining the thermite case and bus bars with low melting point metal. Herein, therefore, mainly the thermite case and bus bars are described.

In this embodiment, the constitution except for the thermite case and bus bars shown in FIG. 11 to FIG. 14 is same as the constitution of the third embodiment shown in FIG. 8 to FIG. 10, and the circuit cut-off operation is also same as in third embodiment, and their description is omitted.

As shown in FIG. 11 to FIG. 14, a round hole 12 is formed at one end of the first bus bar 11*a*, and a round hole 20 is formed at one end of the second bus bar 19*a*, and other ends of the first bus bar 11*a* and second bus bar 19*a* are arranged so as to enclose the thermite case 26*a*, and the bent parts 8, 10 of the bus bars and the thermite case 26*a* are bonded with low melting point metal 23.

The thermite case 26*a* is composed of a rectangular parallelepiped 50*a* and a tube 50*b*, and recesses 51 are formed near four corners of the lower side of the rectangular parallelepiped 50*a* for positioning of the bus bars and thermite case 26*a*. At the upper side of the thermite case 26*a*, an opening 53 is formed for accommodating the heating agent 27, and this opening 53 is sealed by an upper lid 42 of a disk form.

Figure 12:
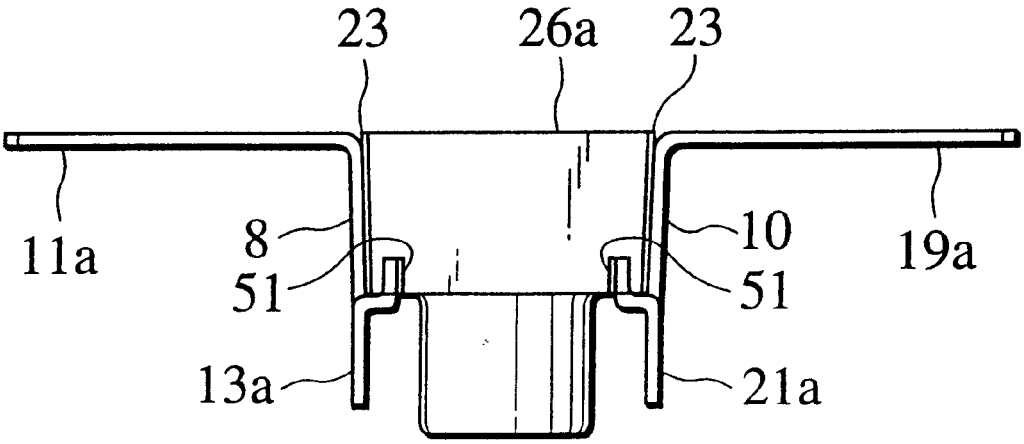
FIG. 12 is a sectional view of thermite case and bus bar of the embodiment.
Figure 13:
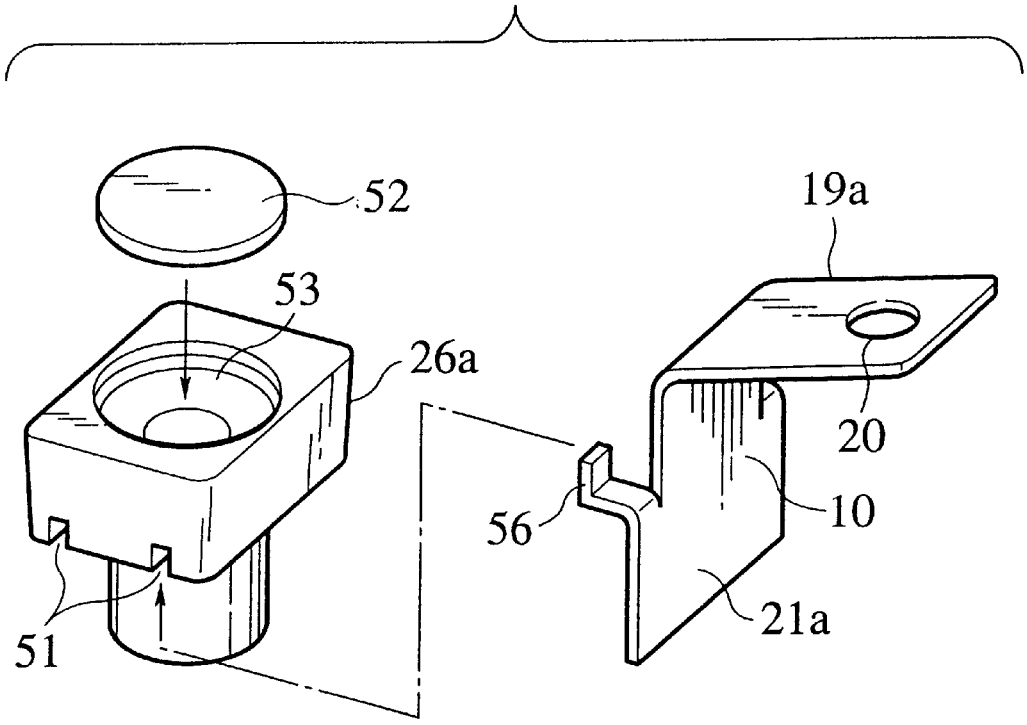
FIG. 13 is a diagram explaining positioning by fitting of the thermite case and bus bar of the embodiment.
Figure 14:
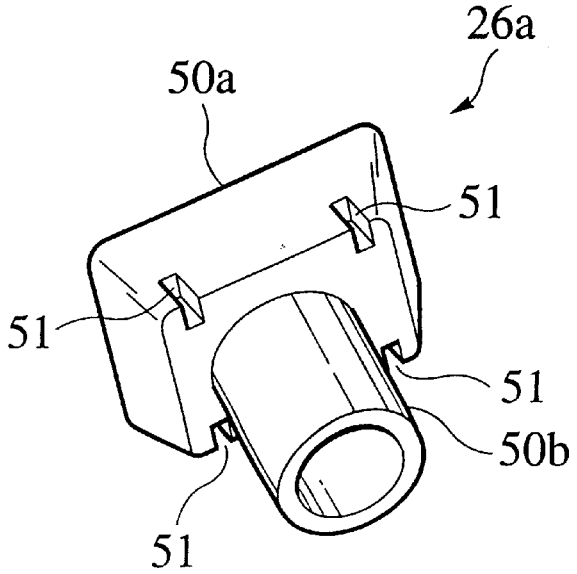
FIG. 14 is a detailed view of the thermite case of the embodiment.

In the bent part 10 of the second bus bar 19*a* shown in FIG. 12, both sides are notched, and at the notched ends, a pair of convex parts 56 are formed to be fitted with a pair of concave parts 41 at the right side of the thermite case 26*a*, and the constitution of the first bus bar 11*a* is same as that of the second bus bar 19*a*, and a pair of convex parts 56 are also formed in the second bus bar 19*a*.

In thus constituted circuit breaker of the embodiment, by pushing the thermite case 26*a* until the convex parts 56 formed in the first bus bar 11*a* and second bus bar 19*a* are engaged with the convex parts 51 formed in the thermite case 26*a*, it is easy to position the first bus bar 11*a* and second bus bar 19*a* with the thermite case 26*a* when bonding with the low melting point metal 23.

Of course, the positioning constitution of the circuit breaker of this embodiment can be applied, as required, to the first and second embodiments.

A circuit breaker in a fifth embodiment of the invention is described below.

The circuit breaker of this embodiment is characterized by assuring double reliability of the low melting point metal and connection by pressing the side walls of the thermite case with protrusions of the bus bars.

Figure 15:
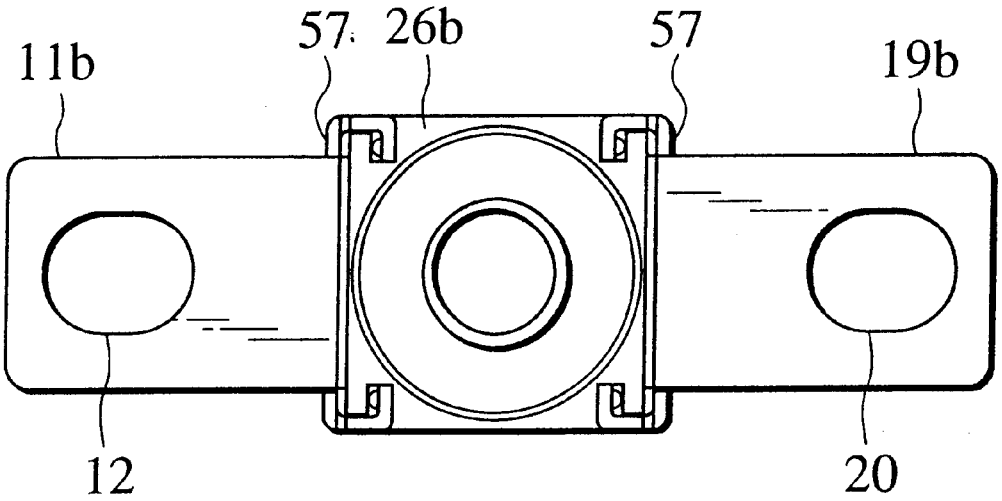
FIG. 15 is a top view of a circuit breaker in a fifth embodiment of the invention.
Figure 16:
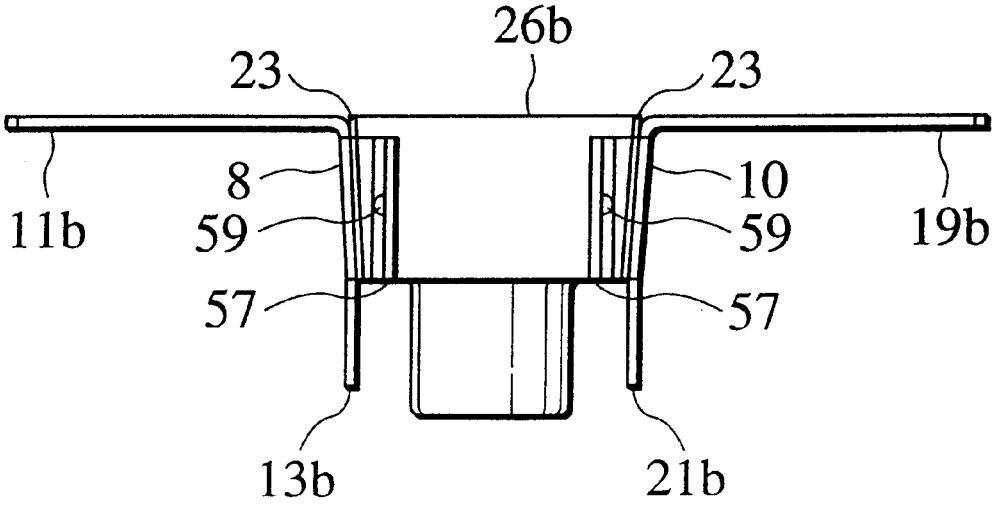
FIG. 16 is a sectional view of thermite case and bus bar of the embodiment.
Figure 17:
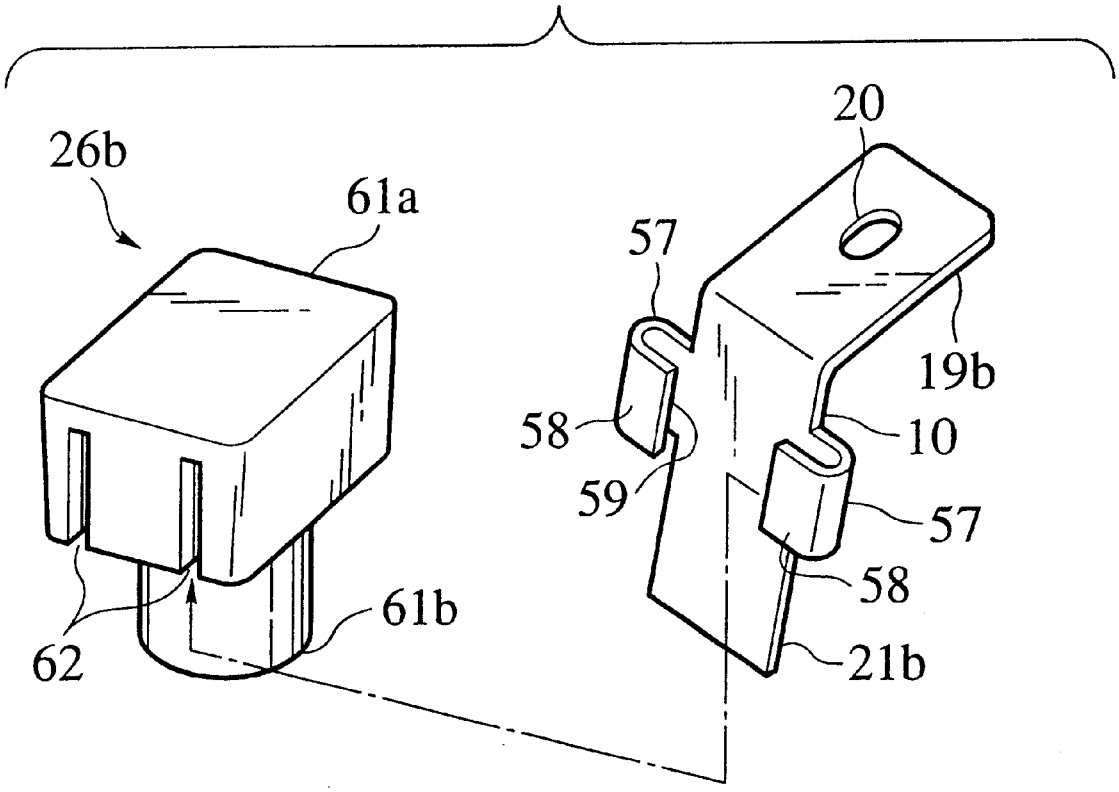
FIG. 17 is a diagram explaining bonding of the thermite case and bus bar of the embodiment.

In this embodiment, the constitution except for the thermite case and bus bars shown in FIG. 15 to FIG. 17 is same as the constitution of the third embodiment shown in FIG. 8 to FIG. 10, and the circuit cut-off operation is also same as in third embodiment, and their description is omitted.

In FIG. 15 to FIG. 17, a round hole 12 is formed at one end of the first bus bar 11*b*, and a round hole 20 is formed at one end of the second bus bar 19*b*, and other ends of the first bus bar 11*b* and second bus bar 19*b* are arranged so as to enclose the thermite case 26*b*, and the bent parts 8, 10 of the bus bars and the thermite case 26*b* are bonded with low melting point metal 23.

The thermite case 26*b* is composed of a rectangular parallelepiped 61*a* and a tube 61*b*, and four long grooves 62 are formed at side walls of the rectangular parallelepiped 61*a*. In the second bus bar 19*b*, a pair of curved parts curved outward in a semicircular form are formed in the bent part 10, and a slightly projecting semicircular protrusion 59 is formed at the leading end of the curved part 57.

The leading end of the curved part 57 and the protrusion 59 are designed to be fitted with the long groove 62 formed in the thermite case 26*b*.

The constitution of the first bus bar 11*b* is same as that of the second bus bar 19*b*, and its description is omitted.

In thus constituted circuit breaker of the embodiment, by inserting the leading ends of the bent parts 57 formed in the first bus bar 11*b* and second bus bar 19*b* into the long grooves 62 formed in the thermite case 26*b*, the protrusions 59 press the long grooves 62. That is, the side walls of the thermite case 26*b* are pressed by the protrusions 59 of the first bus bar 11*b* and second bus bar 19*b*.

Therefore, in this embodiment, while connecting by the low melting point metal 23, the electric connection of the first bus bar 11*b* and second bus bar 19*b* with the thermite case 26*b* is assured by the protrusions 59 of the first bus bar 11*b* and second bus bar 19*b*, so that the connection reliability may be doubled.

Of course, the positioning constitution of the circuit breaker of this embodiment can be applied, as required, to the first and second embodiments.

A modified example of the circuit breaker in the fifth embodiment of the invention is described below.

Figure 18:
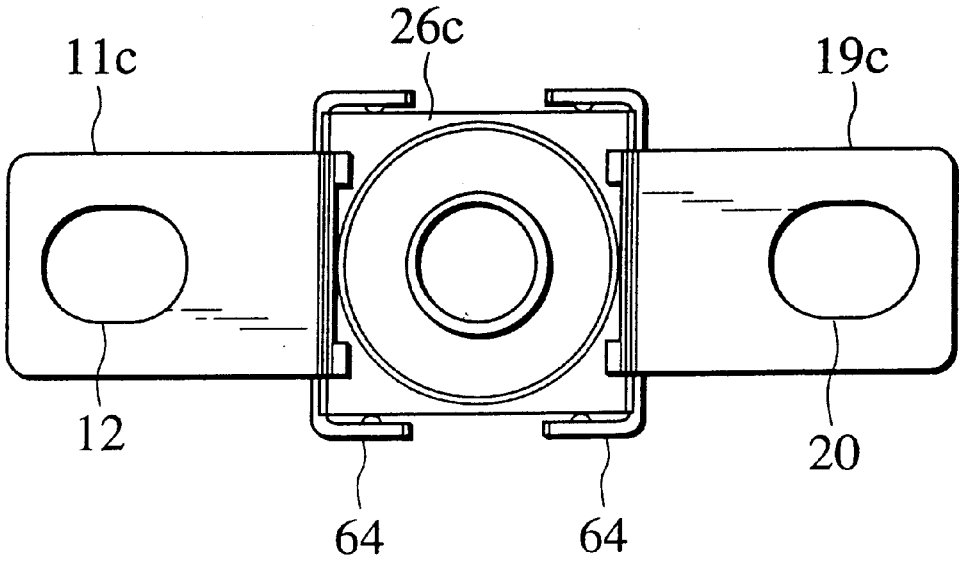
FIG. 18 is a top view of a circuit breaker in a modified example of the fifth embodiment of the invention.
Figure 19:
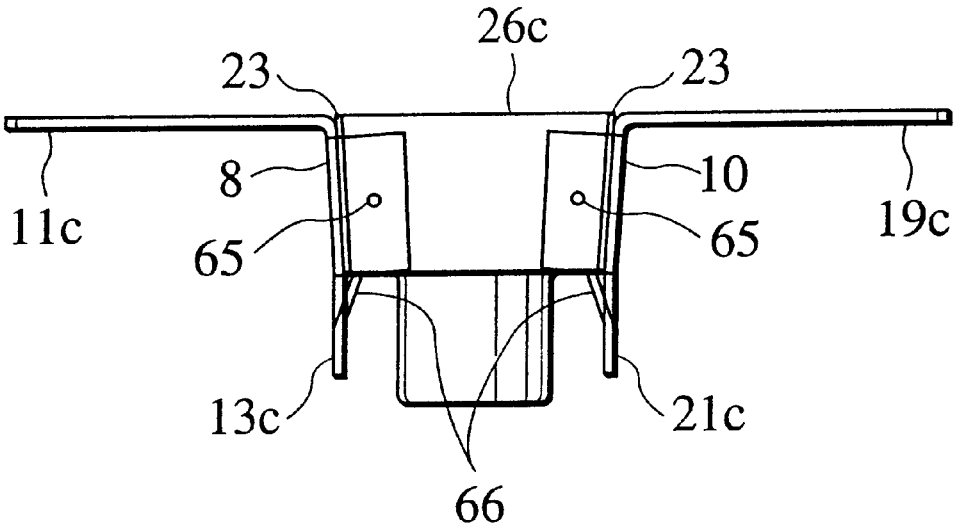
FIG. 19 is a sectional view of thermite case and bus bar of the same.
Figure 20:
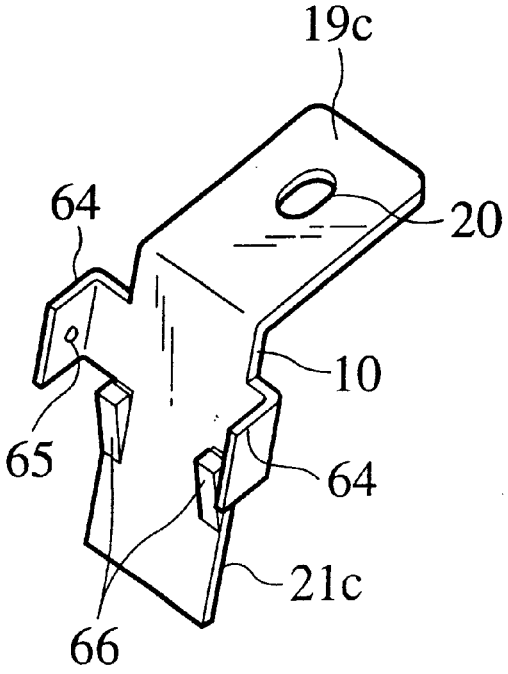
FIG. 20 is a detailed structural view of the bus bar of the same.

The circuit breaker of this modified example shown in FIG. 18 to FIG. 20 is also characterized by assuring double reliability of the low melting point metal and connection by pressing the side walls of the thermite case with protrusions of the bus bars.

A round hole 12 is formed at one end of the first bus bar 11*c*, and a round hole 20 is formed at one end of the second bus bar 19*c*, and other ends of the first bus bar 11*c* and second bus bar 19*c* are arranged so as to enclose the thermite case 26*c*, and the bent parts 8, 10 and the thermite case 26*c* are bonded with low melting point metal 23 same as in the fifth embodiment.

A pair of L-shaped parts 64 are formed at the bent part 19 of the second bus bar 19*c*, and a slightly projecting hemispherical protrusion 65 is formed at the inner wall of the L-shaped part 64. The L-shaped part 64 and the protrusion 65 are pressing the side wall of the thermite case 26*c*.

At the lower side of the L-shaped part 64, a wedgeshaped projecting stopper 66 is formed for positioning the thermite case 26*c* in the vertical direction. The constitution of the first bus bar 11*c* is same as in the second bus bar 19*c*, and the description is omitted.

In thus constituted modified example of the circuit breaker, by enclosing the side walls of the thermite case 26*c* by the L-shaped parts 64 formed in the first bus bar 11*c* and second bus bar 19*c*, the protrusions 65 press the side walls of the thermite case 26*c*.

In this modified example, too, the electric connection of the first bus bar 11*c* and second bus bar 19*c* and the thermite case 26*c* is assured by the protrusions 65. Together with the connection by the low melting point meal 23, the reliability of the connection is assured in double. Further, since the stopper 66 is provided, the thermite case 26*c* may be positioned easily in the vertical direction.

A similar stopper is applied in a modified example of the circuit breaker of the fourth embodiment.

Figure 21:
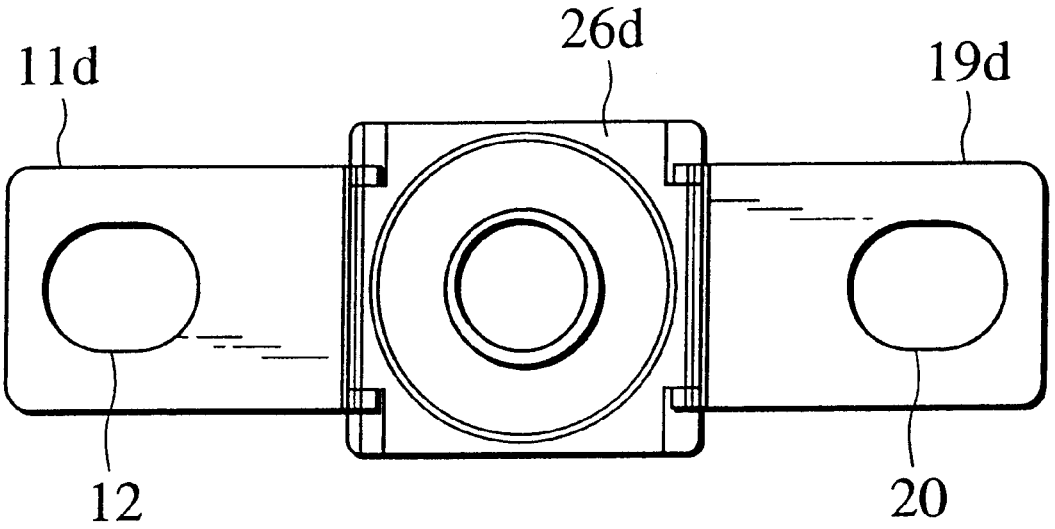
FIG. 21 is a top view of a circuit breaker in a modified example of the fifth embodiment of the invention.
Figure 22:
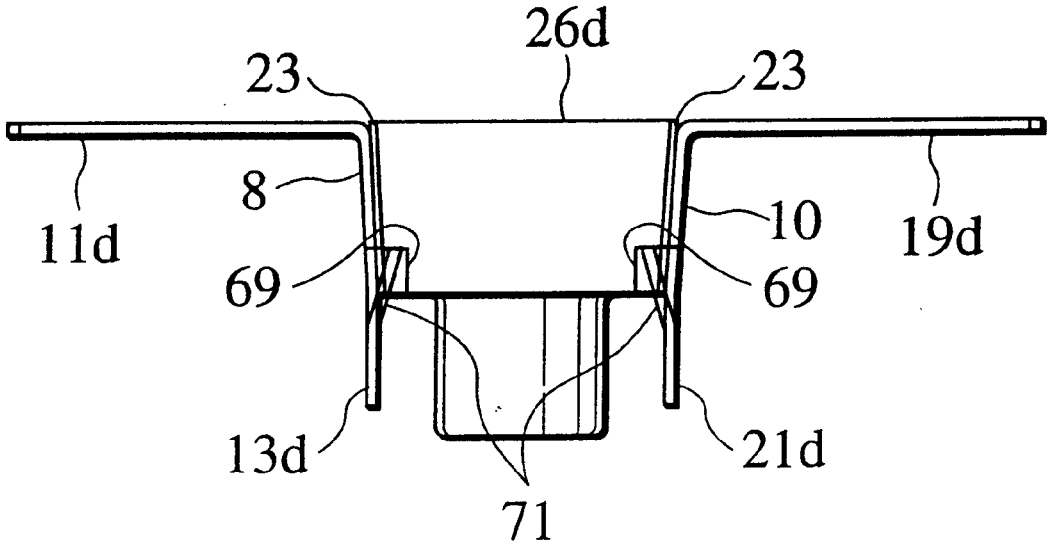
FIG. 22 is a sectional view of thermite case and bus bar of the same.
Figure 23:
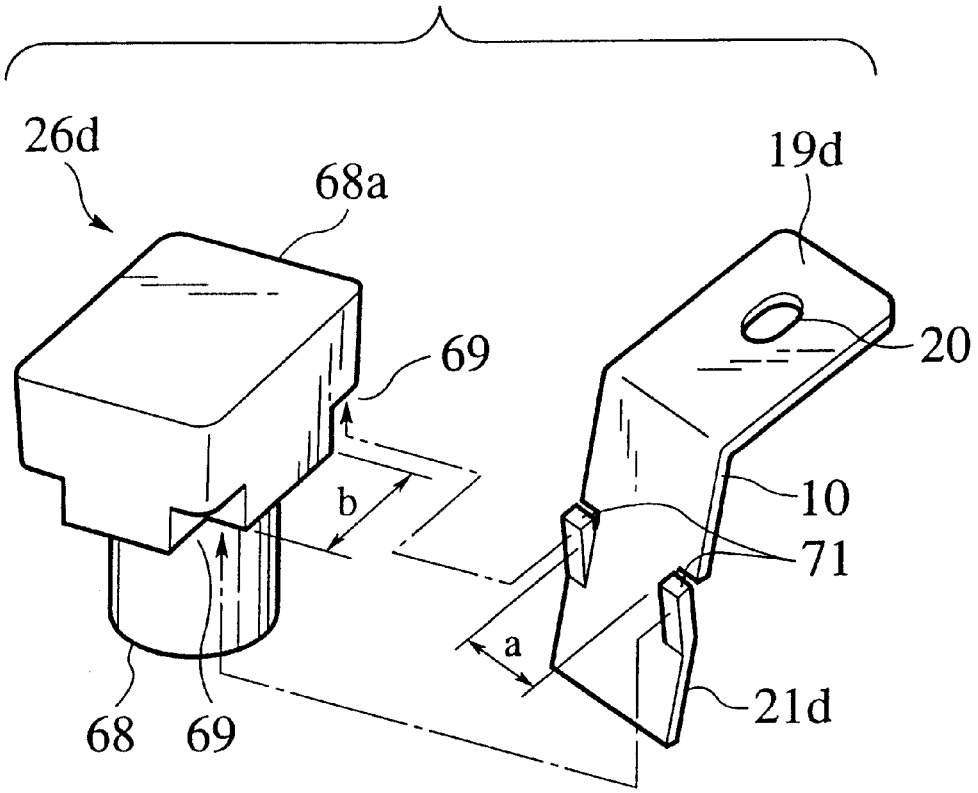
FIG. 23 is a diagram explaining positioning of the thermite case in the vertical and lateral directions of the same.

The modified example of the circuit breaker in the fourth embodiment shown in FIG. 21 to FIG. 23 is characterized by easy positioning of the thermite case and bus bars in the vertical and lateral direction.

That is, other ends of the first bus bar 11*d* and second bus bar 19*d* are arranged so as to enclose the thermite case 26*d*, and the bent parts 8, 10 and the thermite case 26*d* are bonded with low melting point metal 23.

The thermite case 26*d* is composed of a rectangular parallelepiped 68*a* and a tube 69*b*, and square grooves 69 are formed near four corners of the lower side of the rectangular parallelepiped 68*a*. In the bent part 10*d* of the second bus bar 19*d*, a pair of stoppers 71 cutting off part of the bus bar and projecting like a wedge are formed in the lateral direction, and the pair of stoppers 71 abut against the pair of grooves 69 formed in the thermite case 26*d*.

Herein, as shown in FIG. 23, the distance a between the pair of stoppers 71 and the distance b between the pair of grooves 69 is set nearly equal to each other.

The constitution of the first bus bar 11*d* is similar to that of the second bus bar 19*d*, and the description is omitted.

In this constitution of the modified example, when the thermite case 26*d* is pressed downward, the four grooves 69 formed in the thermite case 26*d* abut against the four stoppers 71 formed in the first bus bar 11*d* and second bus bar 19*d*.

Therefore, in this modified example, too, positioning of the thermite case 26*d* and first bus bar 11*d* and second bus bar 19*d* is easy in the vertical and lateral direction.

A circuit breaker in a sixth embodiment of the invention is described below.

Figure 25:
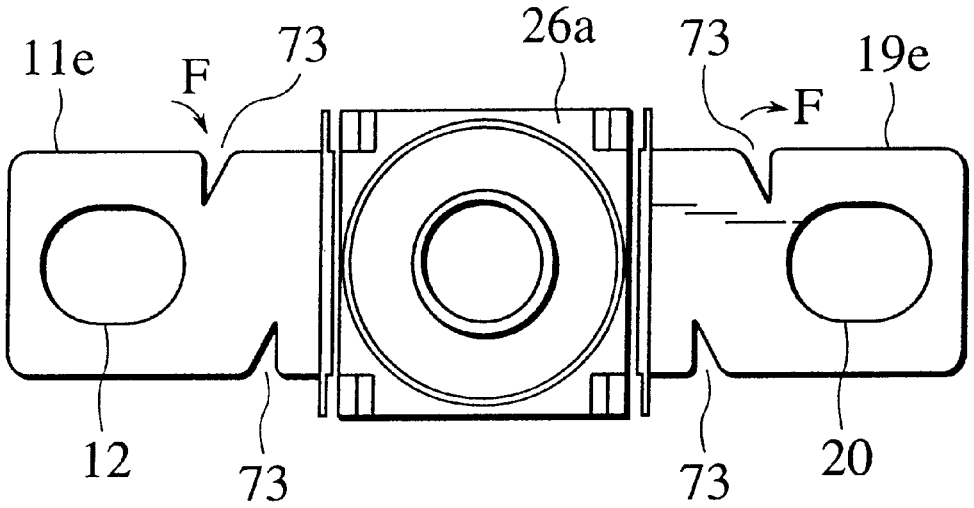
FIG. 25 is a top view of a circuit breaker in a sixth embodiment of the invention.
Figure 26:
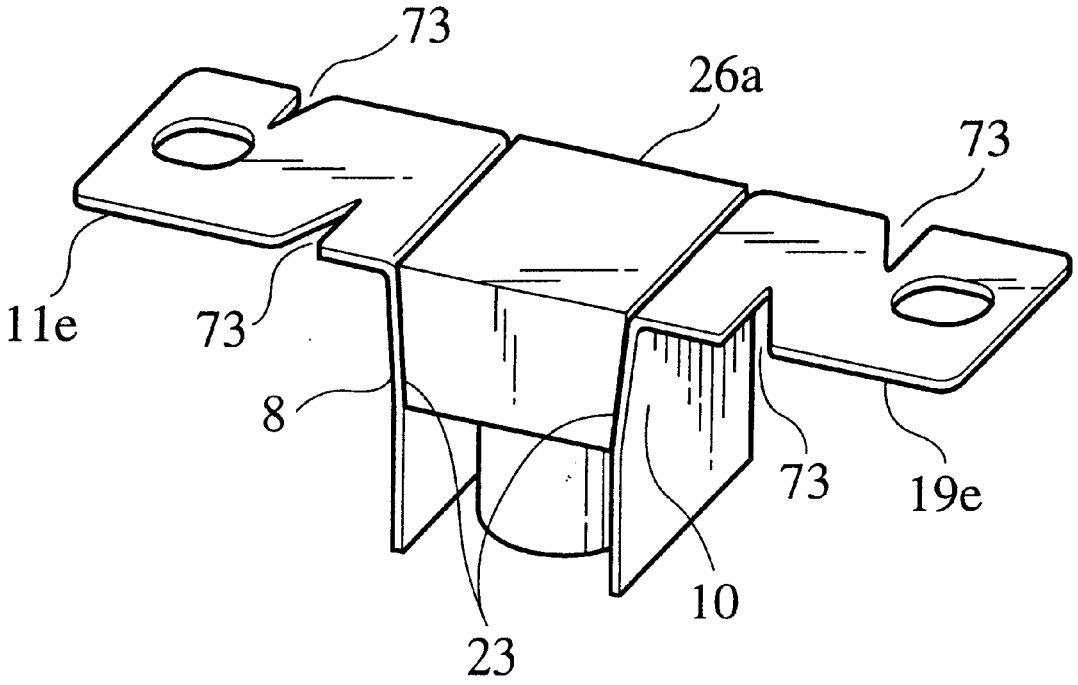
FIG. 26 is a perspective view of thermite case and bus bar of the embodiment.

In this embodiment, the constitution except for the thermite case and bus bars shown in FIG. 25 and FIG. 26 is same as the constitution of the fourth embodiment shown in FIG. 11 to FIG. 14, and its circuit cut-off operation is also same as explained in the fourth embodiment, and their description is omitted herein.

Figure 11:
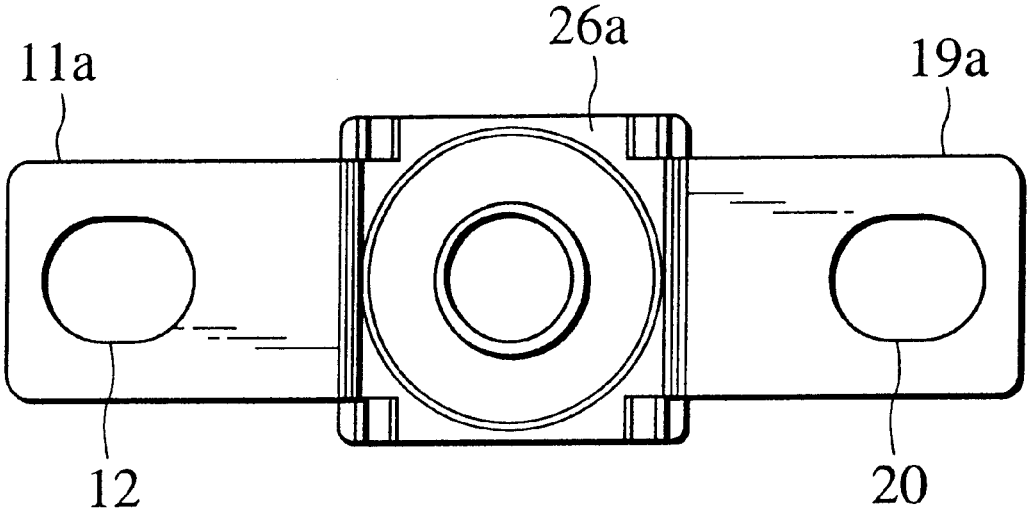
FIG. 11 is a top view of a circuit breaker in a fourth embodiment of the invention.
Figure 24:
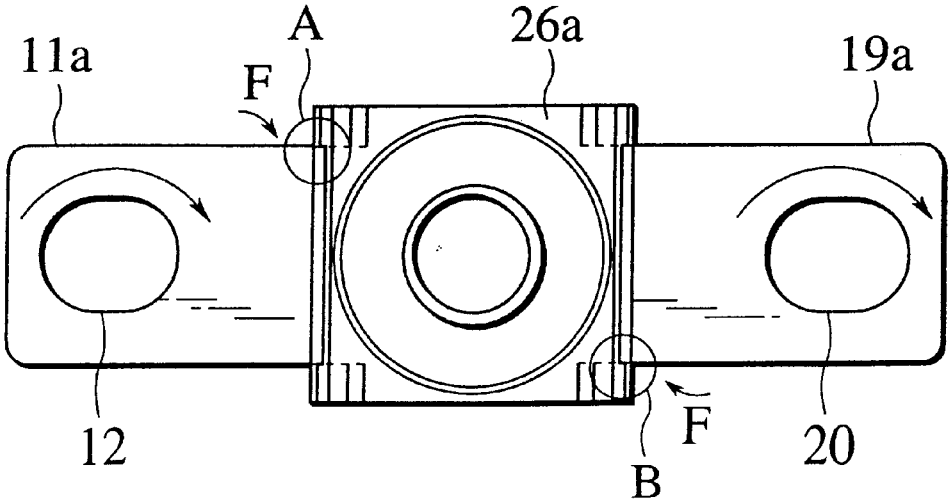
FIG. 24 is a diagram explaining the force applied to the thermite case and low melting point metal by rotation of screw tightening of bus bar.

In FIG. 24 corresponding to FIG. 11 explained in the fourth embodiment, when tightened by turning screws clockwise by inserting screws into a round hole 12 formed in the first bus bar 11*a* and a round hole 20 formed in the second bus bar 19*a*, force F by rotation for tightening the screw as indicated by arrow is applied to part A and part B. Such force may be applied to the junction of the low melting point metal 23 to have adverse effects on the durability of the low melting point metal 23 or tightening of the thermite case.

Accordingly, in the circuit breaker of the sixth embodiment and its modified examples, between the screw tightening portion of the bus bars and the thermite case, notches are provided to absorb stress and vibration from the bus bars, and transmission of stress from the bus bars to the junction of the low melting point metal 23 is suppressed, thereby preventing loss of durability of low melting point metal 23 and adverse effects on cut-off by tightening of the thermite case.

First, in the circuit breaker of the sixth embodiment shown in FIG. 25 and FIG. 26, a round hole 12 is formed at one end of the first bus bar 11*e* and a round hole 20 is formed at one end of the second bus bar 19*e*, and other ends of the first bus bar 11*e* and second bus bar 19*e* are arranged to enclose the thermite case 26*a*, so that the bent parts 8, 10 and thermite case 26*a* are bonded by the low melting point metal 23.

Further, in the first bus bar 11*e*, a pair of triangular notches 73 are formed between the round hole 12 and low melting point metal 23, and also a pair of triangular notches 73 are formed between the round hole 20 and low melting point metal 23 in the second bus bar 19*e*. Herein, pairs of notches 73 are deviated by one position each to the upper side and lower side of the bus bars.

In this constitution, for example, when the screw is passed in the round hole 12 and tightened clockwise in FIG. 25, the clockwise rotating force acts to close the upper side notch 73 and open the lower side notch 73. As a result, the stress by screw tightening rotation is absorbed by the pair of notches 73, and therefore transmission of screw tightening stress to the junction of the low melting point metal 23 is suppressed, and electric faulty contact can be prevented.

Of course, the constitution of the circuit breaker of this embodiment can be applied, as required, to the first to third and fifth embodiments and their modified examples.

Figure 27:
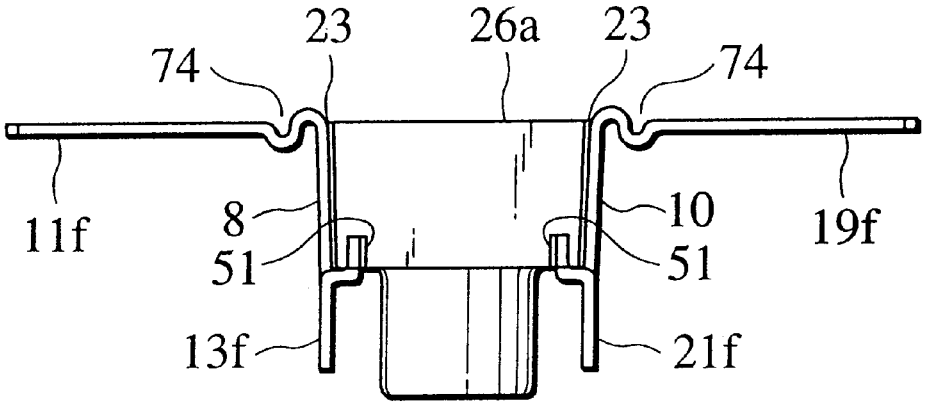
FIG. 27 is a sectional view of thermite case and bus bar in a first modified example of the circuit breaker in the sixth embodiment of the invention.

In a first modified example of the circuit breaker of the sixth embodiment shown in FIG. 27, a wavy curved part 74 is formed at a position slightly remote from the low melting point metal 23 in the first bus bar 11*f*, and also a wavy curved part 74 is formed at a position slightly remote from he low melting point metal 23 in the second bus bar 19*f*. The positions of the curved parts 74 are near the low melting point metal 23, so that the bending radius R may not be less than the plate thickness of the bus bars 11*f*, 19*f*.

According to this constitution, in this modified example, too, if unnecessary force is applied when tightening the screw due to deformation of bus bar or deviation of mounting position, it is absorbed by the wavy curved parts 74 same as in the sixth embodiment, and therefore transmission of screw tightening stress to the junction of the low melting point metal 23 is suppressed, and loss of durability of the low melting point metal 23 can be prevented.

Figure 28:
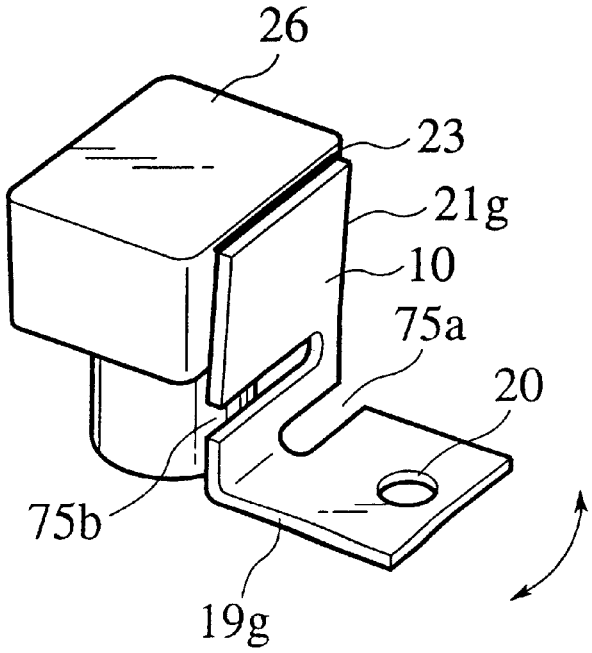
FIG. 28 is a sectional view of thermite case and bus bar in a second modified example of the circuit breaker in the sixth embodiment of the invention.

In a second modified example of the circuit breaker of the sixth embodiment shown in FIG. 28, a round hole 20 is formed at one end of the second bus bar 19*g*, and a pair of notches 75*a*, 75*b* cut off from both right and left sides are formed in the bent part 10 bent nearly at right angle to the surface of the bus bar including the round hole 20. The bus bar leading end 21*g* at the leading end portion of the bent part 10 is bonded to the thermite case 26 by low melting point metal 23. The first bus bar 11*g* is constituted same as the second bus bar 19*a*, and its explanation is omitted.

According to the modified example of such constitution, for example, when the screw is tightened clockwise or counterclockwise by passing the screw into the round hole 20, the stress by screw tightening rotation is absorbed by the deformation of the pair of notches 75*a*, 75*b* in the rotating direction, and therefore transmission of screw tightening stress to the junction of the low melting point metal 23 is suppressed, and electric faulty contact can be prevented.

Figure 29:
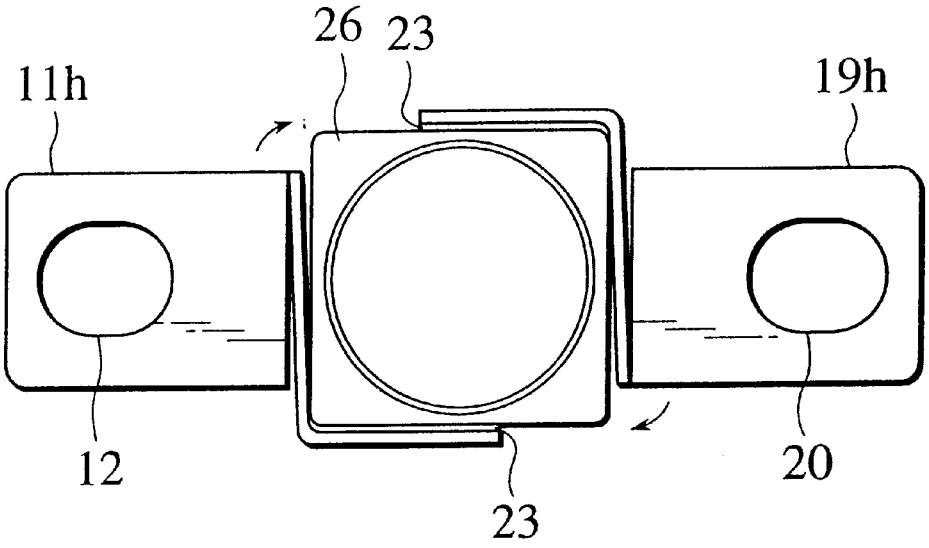
FIG. 29 is a top view of a third modified example of the circuit breaker in the sixth embodiment of the invention.
Figure 30:
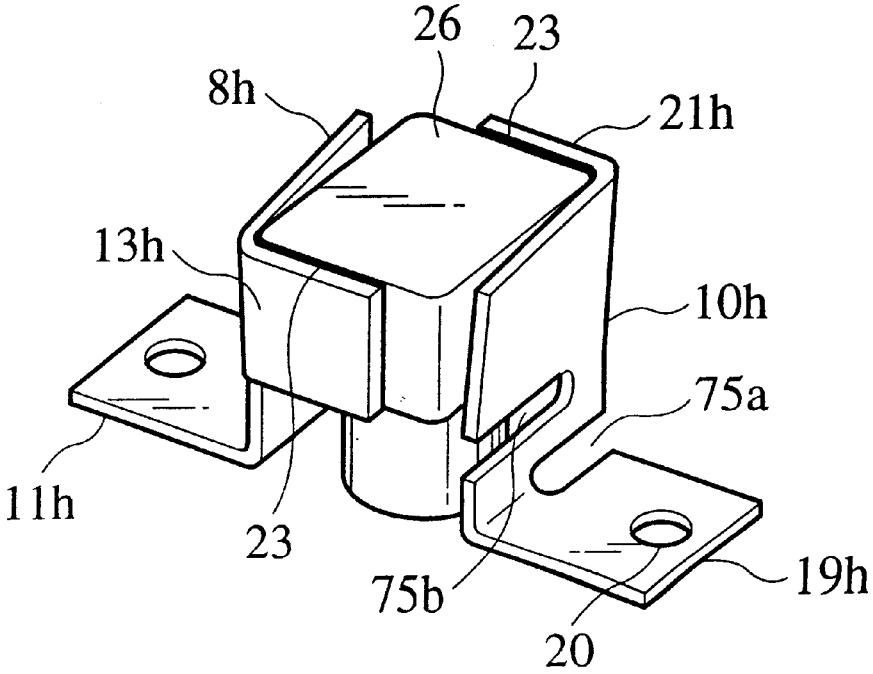
FIG. 30 is a perspective view of thermite case and bus bar of the same.

In a third modified example of the circuit breaker of the sixth embodiment shown in FIG. 29 and FIG. 30, a round hole 20 is formed at one end of the second bus bar 19*h*, and a pair of notches 75*a*, 75*b* cut off from both right and left sides are formed in the bent part 10*h* (corresponding to the shell) bent nearly at right angle to the bus bar part (corresponding to one end) including the round hole 20.

The right side leading end portion of the bent part 190*h* is bent nearly at right angle in the opposite direction of the round hole 20 side, and composes a bus bar leading end portion 21*h* (corresponding to other end), and this bus bar leading end portion 21*h* and bent part 10*h* are nearly L-shaped. The bus bar leading end portion 21*h* is nearly same in the vertical size as the upper side rectangular parallelepiped of the thermite case 26, and is bonded to the thermite case 26 with low melting point metal 23.

Moreover, the gap between the right side wall of the thermite case 26 and the bent part 10*h* becomes larger as the position of the bent part 10*h* is away from the bus bar leading end portion 21*h*, and the stress by screw tightening rotation is absorbed by such gap. The first bus bar 11*h* is constituted same as the second bus bar 19*h*, and its explanation is omitted.

According to the modified example of such constitution, for example, when the screw is tightened clockwise or counterclockwise by passing the screw into the round hole 20, the stress by screw tightening rotation is absorbed by the pair of notches 75*a*, 75*b*.

Or, as shown in FIG. 29, when the screw is tightened clockwise, the stress by screw tightening rotation is transmitted to the bent part 10*h*, and this bent part 10*h* is a bout to rotate clockwise (arrow direction in FIG. 29). At this time, since a wedge-shaped gap is formed between the right side wall of the thermite case 26 and the bent part 10*h*, the stress is absorbed in this gap, and therefore the stress absorbing effect is greater than the effect of the circuit breaker in the second modified example.

Figure 31:
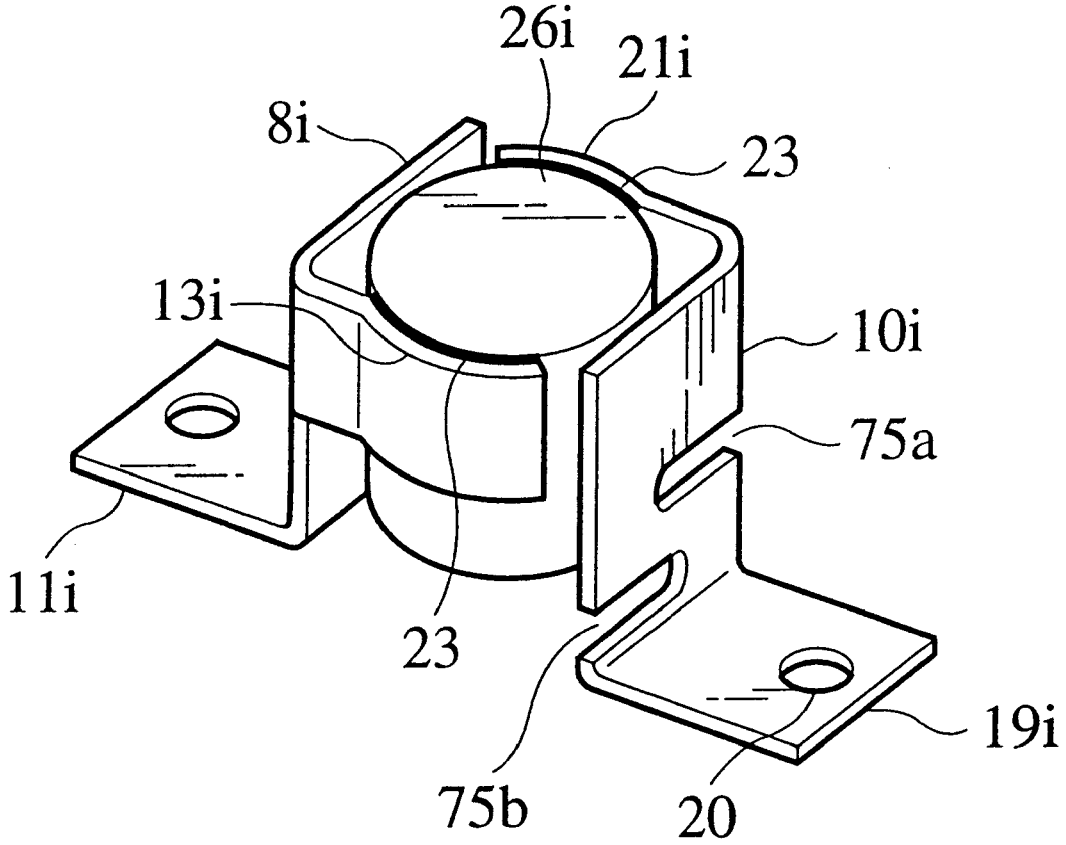
FIG. 31 is a perspective view of thermite case and bus bar in a fourth modified example of the circuit breaker in the sixth embodiment of the invention.
Figure 32:
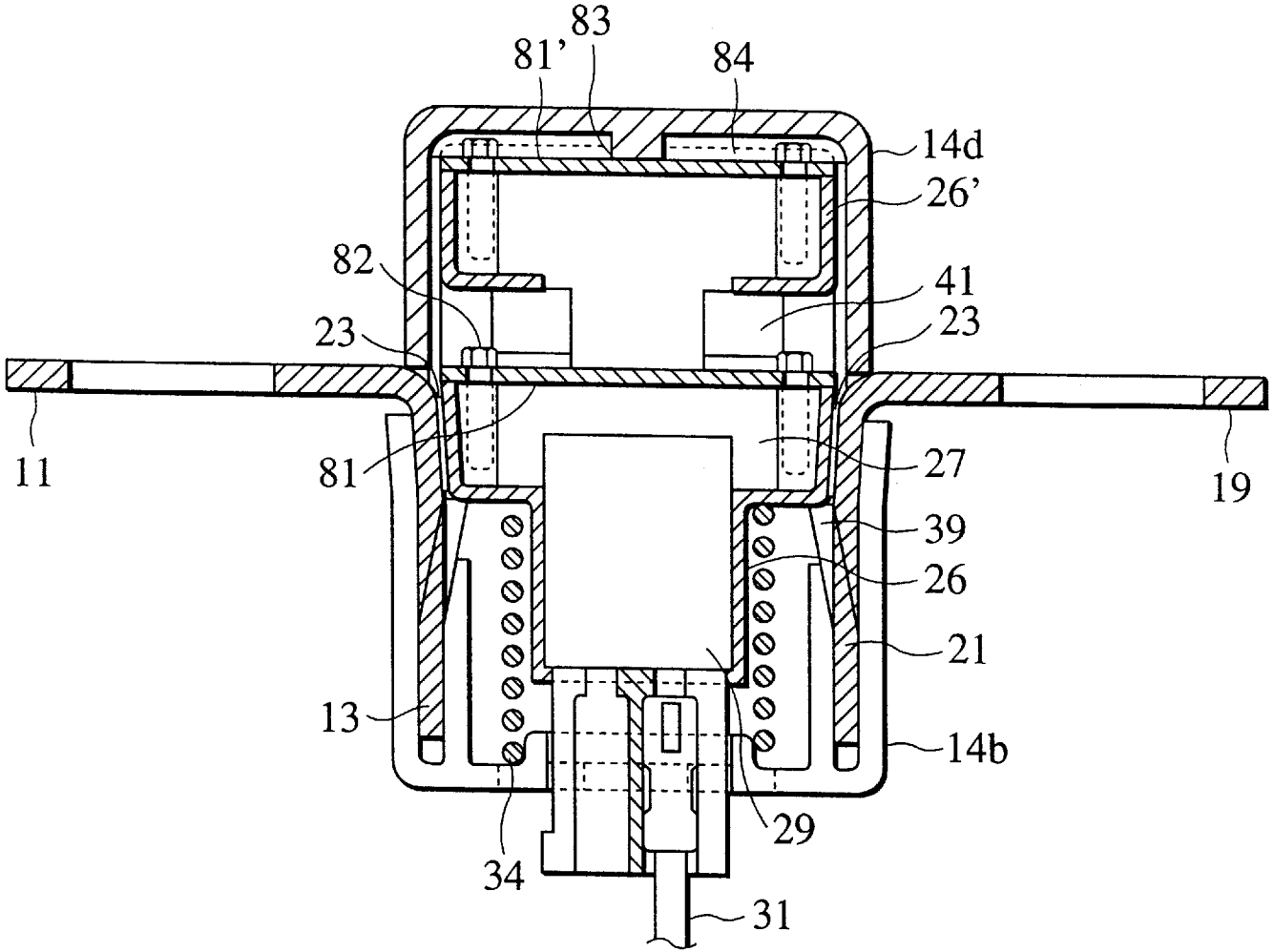
FIG. 32 is a sectional view of a circuit breaker in a seventh embodiment of the invention.

A fourth modified example of the circuit breaker of the sixth embodiment shown in FIG. 31 is an application example of the third modified example. That is, the thermite case 26*i* is a cylindrical structure, and conforming to the circular shape of the cylindrical structure of the thermite case 26*i*, the bus bar leading end portion 21*i* is formed in an arc, and the bus bar leading end portion 21*i* and the thermite case 26*i* are bonded with low melting point metal 23. The other constitution of the circuit breaker in the fourth modified example is same as the constitution of the circuit breaker in the third modified example.

In the circuit breaker of such fourth modified example, the same effects as in the circuit breaker of the third modified example are obtained.

Finally, a circuit breaker in a seventh embodiment of the invention is described below.

In this embodiment, In FIG. 32 to FIG. 35, same parts as in the parts in the third embodiment shown in FIG. 8 to FIG. 10 are identified with same reference numerals, and their detailed description is omitted, and mainly the characteristic feature of the embodiment is explained below.

A cap 14*d* is an upper case, which is put cover a lower case 14*b*. An upper lid 81 is put on the thermite case 26 filled with a heating agent 27, and this upper lid 81 is tightened by a bolt 82.

Figure 33:
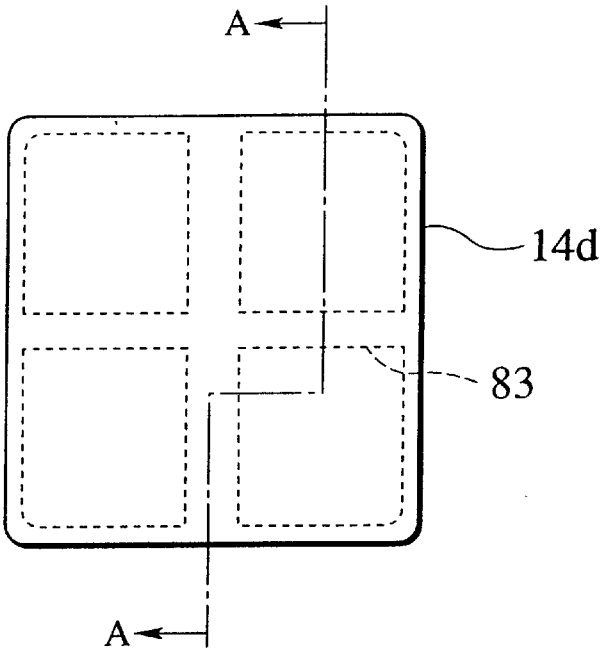
FIG. 33 is a top view of cap of the embodiment.
Figure 34:
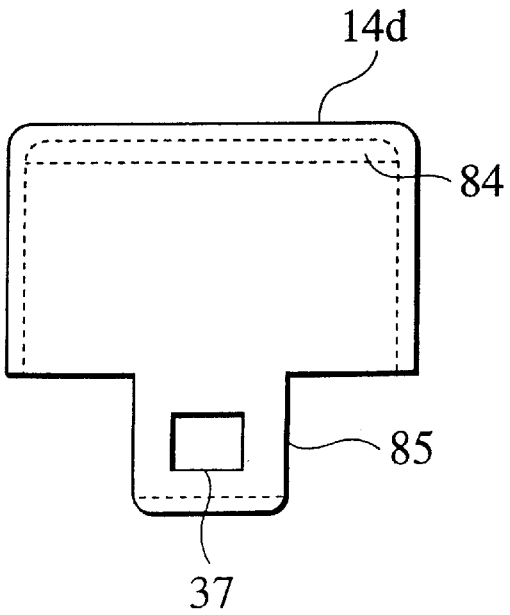
FIG. 34 is a side view of the cap of the embodiment.
Figure 35:
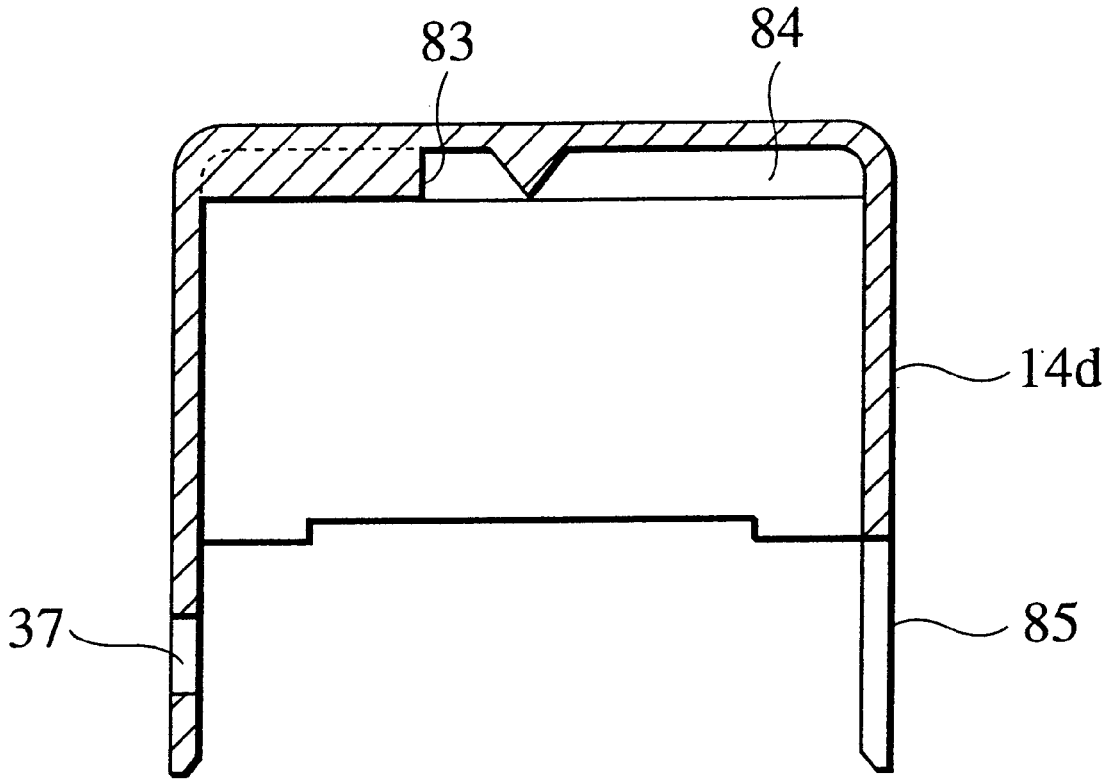
FIG. 35 is a sectional view of A—A of the cap of the embodiment.
Figure 36:
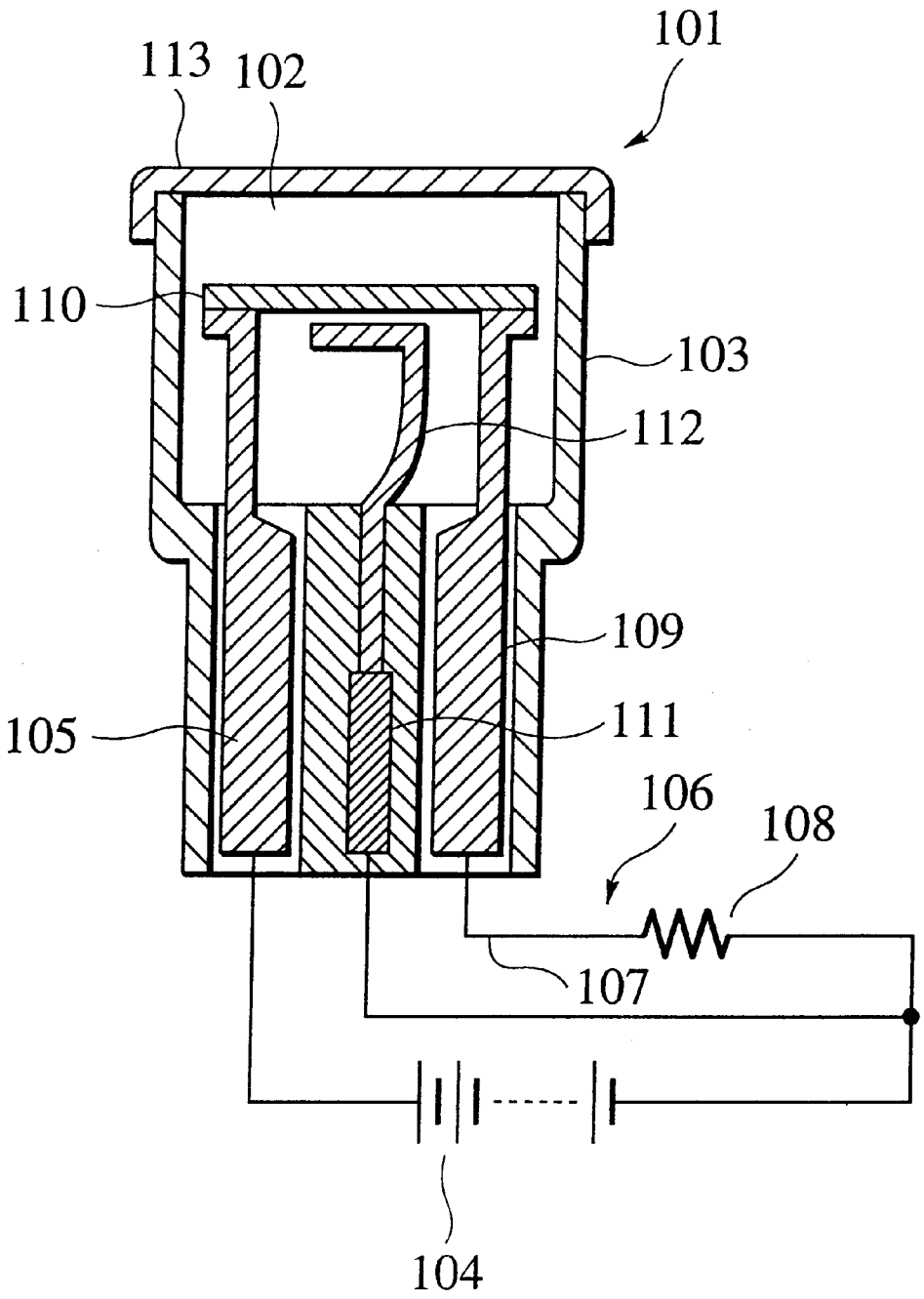
FIG. 36 is a sectional view showing an example of a protective device using a bimetal.
Figure 37:
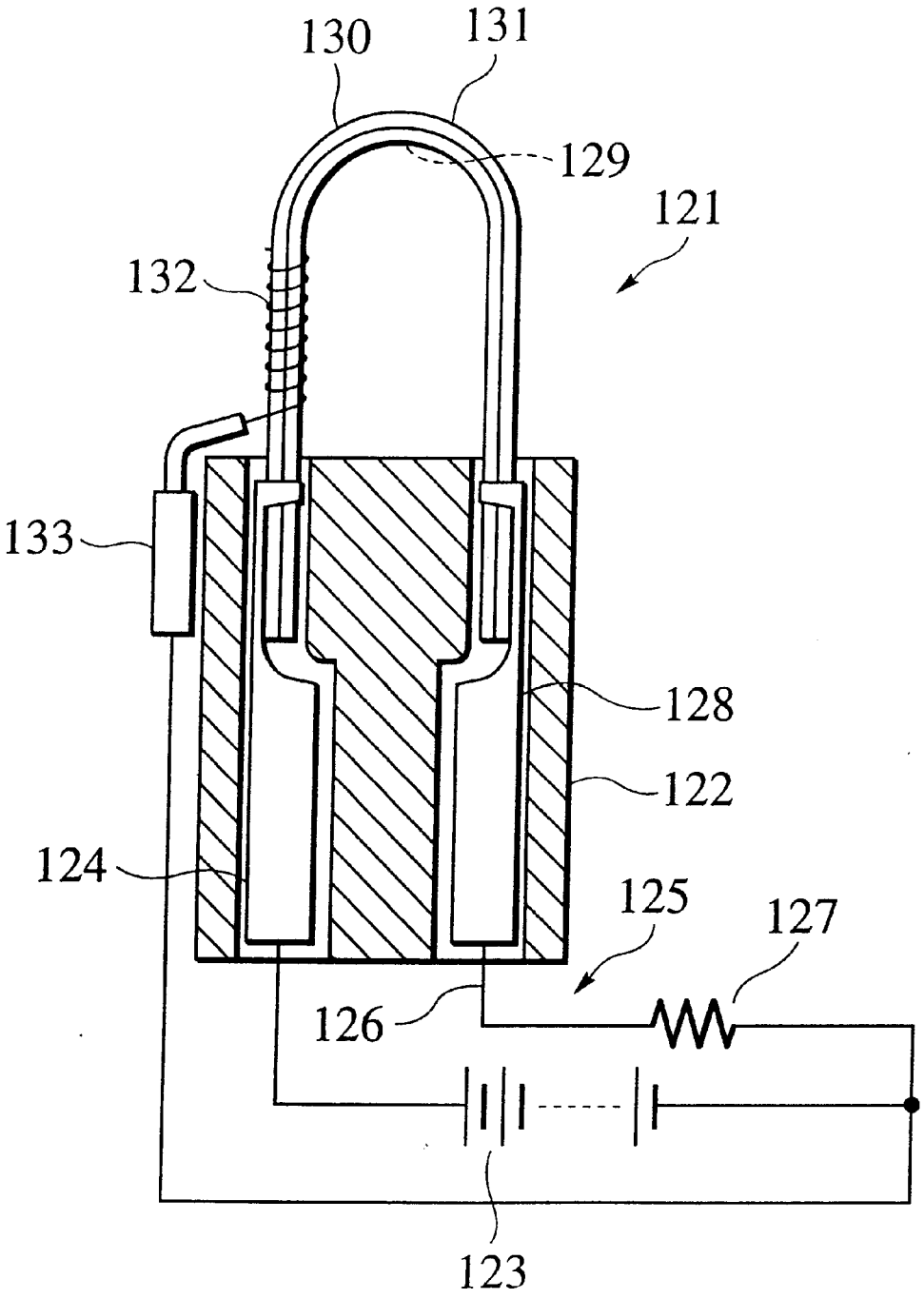
FIG. 37 is a sectional view showing other example of the protective device.

A protruding stopper 83 is formed at a position opposite to the upper lid 81 of the thermite case 26 of the inner wall of the cap 14*d*, and this stopper 83 is formed in a cross form on the inner wall of the cap 14*d* as shown in FIG. 33. At the existence of such stopper 83, an air layer 84 is formed between the inner wall of the cap 14*d* and the upper lid 81.

The protruding shape of the cap 14*d* is not limited to the cross form as shown in FIG. 33, but may include circle, curve, two-dimensional shape or straight line.

At both sides of the cap 14*d*, protrusions 85 are formed, and inside of the protrusions 85, further, square grooves 37 are formed so as to be fitted to the first protrusion 39 formed in the lower case 14*b*.

In this constitution, in the circuit breaker of this embodiment, the circuit is cut off according to failure detection of vehicle, same as in the circuit cut-off operation of the circuit breaker in the third embodiment. At this time, the thermite case 26 pops up to abut against the stopper 83 formed in the cap 14*d*, but since the stopper 83 is formed in a cross form in the cap 14*d* and the air layer 84 is formed between the cap 14*d* and thermite case 26, deformation of the cap 14*d* due to heating of the thermite case 26 can be suppressed. At the same time, drop-out of the cap 14*d* due to deformation of the cap 14*d* is prevented.

Further, when the circuit is cut off, since the thermite case 26 is pressed to the cap 14*d* by the compression spring 34, if vibration is applied to the vehicle, the thermite case 26 is not lowered, and therefore the thermite case 26 will not contact with the bus bar, and the circuit cut-off state can be maintained.

Moreover, since the thermite case 26 is covered with the cap 14*d* and the cap 14*d* is fixed to the lower case 14*b* by the groove 37, when the circuit is cut off, risks of pop-up of thermite case 26 or burn by heat can be lowered.

Of course, the constitution of the circuit breaker of this embodiment can be applied, as required, to the first, second, and fourth to sixth embodiments and their modified examples.

The invention is not limited to the illustrated embodiments and examples at all.

In the first embodiment, for example, forming threaded parts 28 and low melting point metal 23, the circuit is cut off when the threaded parts 28 and low melting point metal 23 are melted, but it is also possible to constitute, by using the threaded parts 28 only without forming low melting point metal 23, to cut off the circuit when the threaded parts 28 are melted.

Similarly, in the third embodiment, the circuit is cut off when the second protrusion 41 and low melting point metal 23 are melted, but it is also possible to constitute, by using the second protrusion 41 only without forming low melting point metal 23, to cut off the circuit when the second protrusion 41 is melted.

Besides, the invention may be further changed and modified in various forms within the technical scope thereof.

What is claimed is:

1. A circuit breaker comprising:

a first connection terminal;

a second connection terminal;

a heat generating part having conductivity and disposed between said first connection terminal and second connection terminal;

an igniting part igniting depending on a cut-off signal;

an expandable elastic member capable of applying a force to said heat generating part so as to be departed from between said first connection terminal and second connection terminal;

a container containing said heat generating part, said igniting part and said elastic member; and a retaining part retaining said elastic member in compressed state, at least a portion of said retaining part being provided in said container, wherein when said heat generating part is positioned between said first connection terminal and second connection terminal while said retaining part is retaining said elastic member in said compressed state, conductive state between said first connection terminal and said second connection terminal is maintained, and as said igniting part ignites depending on said cut-off signal and said heat generating part generates heat, when said retaining part releases said elastic member, said elastic member applies said force to said heat generating part, and said heat generating part is departed from between said first connection terminal and said second connection terminal, said conductive state between said first connection terminal and said second connection terminal is cut off.

2. A circuit breaker according to claim 1, wherein said retaining part includes a resin part, and said resin part is melted as said igniting part ignites depending on said cut-off signal and said heat generating part generates said heat.

3. A circuit breaker according to claim 2, wherein said retaining part is a fixing part tightening and fixing said heat generating part to said container.

4. A circuit breaker according to claim 3, wherein said fixing part comprises a first threaded part formed in said heat generating part, and a second threaded part formed in said container to be engaged with said first threaded part.

5. A circuit breaker according to claim 2, wherein said retaining part is a protrusion formed in said container so as to resist said force of said elastic member.

6. A circuit breaker according to claim 5, wherein said container is formed by use of an upper case and a lower case to be fitted with said upper case, and said protrusion is formed at a position opposite to an upper surface of said heat generating part at an inner wall of said upper case.

7. A circuit breaker according to claim 1, wherein a side wall is formed at an end of said heat generating part, and an end of said first connection terminal and said side wall, and an end of said second connection terminal and said side wall are bonded respectively with a low melting point material.

8. A circuit breaker according to claim 1, wherein a conductive member is provided between an end of said first connection terminal and an end of said second connection terminal by pressure welding.

9. A circuit breaker according to claim 1, wherein a bent part is respectively formed in said first connection terminal and said second connection terminal, and a groove to be fitted with said bent part is formed in said heat generating part.

10. A circuit breaker according to claim 1, wherein a side wall is formed at an end of said heat generating part, and a protrusion pressing said side wall is respectively formed in said first connection terminal and said second connection terminal.

11. A circuit breaker according to claim 1, wherein a notch is respectively formed in said first connection terminal and said second connection terminal.

12. A circuit breaker according to claim 1, wherein a concave and convex part is respectively formed in said first connection terminal and said second connection terminal.

13. A circuit breaker according to claim 1, wherein a side wall is formed at an end of said heat generating part, and a gap is respectively formed between said first connection terminal and said side wall and between said second connection terminal and said side wall.

14. A circuit breaker according to claim 7, wherein said low melting point material is at least one selected from the group consisting of Sn, Pb, Zn, Al and Cu.

15. A circuit breaker according to claim 1, wherein said heat generating part has a heating agent, and said heating agent includes a thermite compound mixing powder of metal oxide and powder of aluminum.

16. A circuit breaker according to claim 1, wherein said heat generating part contains a heating agent, said heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

17. A circuit breaker according to claim 16, wherein said heating agent further contains additives having alumina, bentonite or talc.

* * * * *